US005497130A

United States Patent [19]

Hirai et al.

[11] Patent Number: 5,497,130

[45] Date of Patent: Mar. 5, 1996

[54] LAYERED TRANSMISSION LINE FILTER WITH A CAPACITIVELY COUPLED ELECTRODE IN A LAYER OPPOSING STRIPLINE RESONATORS

[75] Inventors: Takami Hirai, Nishikamo; Shinsuke Yano, Nagoya, both of Japan

[73] Assignee: NGK Insulators, Ltd., Japan

[21] Appl. No.: 299,073

[22] Filed: Sep. 1, 1994

Related U.S. Application Data

[62] Division of Ser. No. 23,395, Feb. 26, 1993, Pat. No. 5,374, 909.

[30] Foreign Application Priority Data

| | | | |
|---|---|---|---|
| Feb. 28, 1992 | [JP] | Japan | 4-43792 |
| Oct. 6, 1992 | [JP] | Japan | 4-267299 |
| Oct. 6, 1992 | [JP] | Japan | 4-267300 |

[51] Int. Cl.[6] ..... H01P 1/203; H01P 7/08

[52] U.S. Cl. ..... 333/204; 333/219

[58] Field of Search ..... 333/203–205, 333/219, 246

[56] References Cited

U.S. PATENT DOCUMENTS

| | | | |
|---|---|---|---|
| Re. 31,470 | 12/1983 | Bedard et al. | 333/204 |
| 3,451,015 | 6/1969 | Heath | 333/204 |
| 4,418,324 | 11/1983 | Higgins | 333/204 |
| 4,692,726 | 9/1987 | Green et al. | 333/206 |
| 4,963,843 | 10/1990 | Peckham | 333/203 |
| 5,122,768 | 6/1992 | Ito et al. | 333/204 |
| 5,192,926 | 3/1993 | Sogo et al. | 333/204 |
| 5,248,949 | 9/1993 | Eguchi et al. | 333/204 |
| 5,344,695 | 9/1994 | Hirai et al. | 333/205 X |

FOREIGN PATENT DOCUMENTS

| | | | |
|---|---|---|---|
| 0510971 | 10/1992 | European Pat. Off. . | |
| 57-23445 | 5/1982 | Japan . | |
| 0258503 | 11/1986 | Japan | 333/204 |
| 0316002 | 12/1989 | Japan . | |

*Primary Examiner*—Benny Lee
*Assistant Examiner*—Justin P. Bettendorf
*Attorney, Agent, or Firm*—Parkhurst, Wendel & Rossi

[57] ABSTRACT

A compact stripline filter for use in a high frequency circuit for a portable telephone, for example, including an internal ground electrode. The filter includes first resonator having a first main surface, a first ground electrode disposed in an opposed facing relationship to the entire surface of the first main surface of the first resonator, a first dielectric layer interposed between the first main surface of the first resonator and the first ground electrode, and a first internal ground electrode formed in the first dielectric layer and disposed in an opposed facing relationship to a portion of the first main surface of the first resonator.

15 Claims, 32 Drawing Sheets

LAYERED TRANSMISSION LINE FILTER WITH A CAPACITIVELY COUPLED ELECTRODE IN A LAYER OPPOSING STRIPLINE RESONATORS

This is a Division of application of Ser. No. 08/023,395, filed Feb. 26, 1993, (U.S. Pat. No. 5,374,409).

BACKGROUND OF THE INVENTION

1. Field of the Invention

The present invention relates to a transmission line filter, and more particularly to a transmission line filter employed in a high-frequency circuit filter for a high-frequency radio transceiver such as a portable telephone and to a transmission line filter employed in an antenna duplexer.

2. Description of the Related Art

FIG. 1 and FIG. 2 are a schematic exploded perspective view and a perspective view, respectively, of a transmission line filter which has been conceived by the present inventors. In the transmission line filter as shown in FIG. 1, resonators 201 through 203 each of which respectively has one end connected to a ground electrode 701 and respectively constitutes a ¼ wavelength stripline resonator, are formed on a dielectric layer 101 at predetermined intervals. Further, electrodes 301 through 303 are also formed on the dielectric layer 101. Each of electrodes 301 through 303 have one end electrically connected to the ground electrode 701 and the other end respectively spaced at predetermined intervals from open-circuited end portions of the resonators 201 through 203 so as to be opposed to the resonators 201 through 203.

An input electrode 401 and an output electrode 402 are formed on a dielectric layer 102 which is to be stacked on the dielectric layer 101. The input electrode 401 overlaps the resonator 201 disposed on the input side with the dielectric layer 102 interposed therebetween. The output electrode 402 overlaps the resonator 203 disposed on the output side with the dielectric layer 102 interposed therebetween. A dielectric layer 103, an upper surface of which the ground electrode 701 is to be formed on, is stacked on the dielectric layer 102, and the dielectric layers 101 through 103 are combined into a single unit. Thereafter, the resultant product is fired to form a layered product 1000. As shown in FIG. 2, the ground electrode 701 is formed on the upper and lower surfaces of the layered product 1000 and the side surfaces thereof other than an input terminal portion 601 and an output terminal portion 602. In addition, an input terminal 501, which is insulated from the ground electrode 701 and connected to the input electrode 401, is formed in the input terminal portion 601 formed on one side surface of the layered product 1000. An output terminal 502 which is insulated from the ground electrode 701 and connected to the output electrode 402, is formed in the output terminal portion 602 formed on another side surface of the layered product 1000.

An electrical equivalent circuit of the aforementioned transmission line filter is represented as shown in FIG. 3 and constitutes a bandpass filter. Reference numeral 11 indicates a capacitance between the resonator 201 and the input electrode 401. Reference numeral 12 indicates a capacitance between the resonator 203 and the output electrode 402. Reference numerals 21 through 23 respectively indicate a capacitance between the resonator 201 and the electrode 301, a capacitance between the resonator 202 and the electrode 302 and a capacitance between the resonator 203 and the electrode 303. Reference numeral 31 indicates an inductance induced between the resonator 201 and the resonator 202, and reference numeral 32 indicates an inductance induced between the resonator 202 and the resonator 203. Capacitances 201C, 202C, 203C and inductances 201L, 202L, 203L of parallel resonance circuits respectively correspond to capacitances and inductances obtained by expressing the resonators 201, 202, 203 with lumped constants.

There is a strong demand for a reduction in size of a portable telephone terminal using such a bandpass filter, and there is a strong demand for a reduction in size of the bandpass filter itself used inside the terminal accordingly. However, the transmission line filter having the aforementioned conventional structure has a limit of its size reduction.

Furthermore, in order to use such a bandpass filter as a high-frequency circuit filter for the portable telephone terminal or the like or as a filter for an antenna duplexer, it is necessary to set the bandwidth of the filter to a desired range. However, putting neighboring resonators close to each other to increase the degree of coupling therebetween was the only means to make the bandwidth of the aforementioned conventional bandpass filter broader. However, when the resonators are put so close to each other, characteristics of the resonators become extremely sensitive to variations in manufacturing parameters (e.g., variations in printing parameters) or the like, thereby creating a difficulty in stably supplying a bandpass filter having a constant characteristic.

Moreover, putting neighboring resonators away from each other to reduce the degree of coupling therebetween was the only means to make the bandwidth of the aforementioned conventional bandpass filter narrower. In this case, however, a problem arises that the bandpass filter becomes greater in size when the neighboring resonators are spaced away from each other in this way.

SUMMARY OF THE INVENTION

It is, therefore, an object of the present invention to provide a smaller-sized transmission line filter.

It is another object of the present invention to provide a transmission line filter in which the bandwidth thereof can easily be adjusted.

According to the present invention, there is provided a transmission line filter, comprising:

- a first resonator having a first main surface;
- a first ground electrode disposed in an opposed facing relationship to the entire surface of the first main surface of the first resonator;
- a first dielectric layer interposed between the first main surface of the first resonator and the first ground electrode; and
- a first internal ground electrode formed in the first dielectric layer and disposed in an opposed facing relationship to a portion of the first main surface of the first resonator.

Preferably, in the transmission line filter, the first resonator has a second main surface in an opposed relationship to the first main surface, and the transmission line filter further comprises:

- a second ground electrode disposed in an opposed facing relationship to the entire surface of the second main surface of the first resonator, and
- a second dielectric layer interposed between the second main surface of the first resonator and the second ground electrode.

More preferably, the transmission line filter still further comprises a second internal ground electrode disposed in the second dielectric layer and disposed in an opposed facing relationship to a portion of the second main surface of the first resonator The transmission line filter may further comprise a second resonator having a first main surface, the first ground electrode being disposed in an opposed facing relationship to the entire surface of the first main surface of the second resonator, the dielectric layer being interposed between the first main surface of the second resonator and the first ground electrode, and the first internal ground electrode being disposed in an opposed facing relationship to a portion of the first main surface of the second resonator.

Preferably, in this transmission line filter, the first resonator has a second main surface in an opposed relationship to the first main surface of the first resonator and the second resonator has a second main surface in an opposed relationship to the first main surface of the second resonator, and the transmission line filter further comprises:

a second ground electrode disposed in an opposed facing relationship both to the entire surface of the second main surface of the first resonator and to the entire surface of the second main surface of the second resonator, and a second dielectric layer interposed between the second main surface of the first resonator and the second ground electrode and between the second main surface of the second resonator and the second ground electrode.

More preferably, this transmission line filter still further comprises a second internal ground electrode formed in the second dielectric layer and disposed in an opposed facing relationship both to a portion of the second main surface of the first resonator and to a portion of the second main surface of the second resonator.

The first resonator preferably has an end portion short-circuited to the first ground electrode and an open-circuited end portion, and the first internal ground electrode is preferably disposed in the opposed facing relationship at the open-circuit end portion of the first resonator. The second internal ground electrode is also preferably disposed in the opposed facing relationship at the open-circuit end portion of the first resonator. The second resonator preferably has an end portion short-circuited to the first ground electrode and an open-circuited end portion and the first internal ground electrode is preferably in the opposed facing relationship at the open-circuit end portion of the second resonator. The second internal ground electrode is also preferably in the opposed facing relationship at the open-circuit end portion of the second resonator.

Preferably, the width of the first resonator at the open-circuit end portion is greater than that at the short-circuit end portion, and the width of the second resonator at the open-circuit end portion is greater than that at the short-circuit end portion.

According to one embodiment of the present invention, there is provided a transmission line filter, comprising:

a first ground electrode;

a second ground electrode;

a dielectric layer interposed between the first ground electrode and the second ground electrode;

at least two resonators disposed in the dielectric layer; and a first internal ground electrode disposed between the first ground electrode and the at least two resonators and in an opposed facing relationship to a respective portion of each the at least two resonators.

Preferably, the transmission line filter further comprises a second internal ground electrode disposed between the second ground electrode and the at least two resonators and in an opposed facing relationship to a respective portion of each the at least two resonators.

Preferably, each of the at least two resonators has an end portion short-circuited to the first ground electrode and an open-circuited end portion, and the first internal ground electrode is preferably disposed in the opposed facing relationship at respective open-circuit end portions of the at least two resonators. The second internal ground electrode is also preferably disposed in the opposed facing relationship at respective open-circuit end portions of the at least two resonators.

Preferably, the width of each the at least two resonators at respective the open-circuit end portions is greater than that at respective short-circuit end portions.

According to another embodiment of the present invention, there is provided a transmission line filter, comprising:

a first ground electrode;

a second ground electrode;

a dielectric layer interposed between the first ground electrode and the second ground electrode;

at least two resonators disposed in the dielectric layer; and at least one internal ground electrode respectively disposed between each neighboring pair of the at least two resonators, the at least one internal ground electrode being disposed in an opposed facing relationship to a respective portion of each resonator of the each neighboring pair of the at least two resonators.

Preferably, the transmission line filter further comprises:

a second internal ground electrode disposed between the first ground electrode and the at least two resonators in an opposed facing relationship to a portion of the nearest resonator to the second internal ground electrode; and a third internal ground electrode disposed between the second ground electrode and the at least two resonators in an opposed facing relationship to a portion of the nearest resonator to the third internal ground electrode.

Preferably, each of the at least two resonators has an end portion short-circuited to the first ground electrode and an open-circuited end portion, and the at least one first internal ground electrode is preferably disposed in the opposed facing relationship at respective the open-circuit end portion of each resonator of the each neighboring pair of the at least two resonators. The second internal ground electrode is also preferably disposed in the opposed facing relationship at the open-circuit end of its the nearest resonator, and the third internal ground electrode is also preferably disposed in the opposed facing relationship at the open-circuit end of its the nearest resonator.

Preferably, the width of each the at least two resonators at respective the open-circuit end portions is greater than that at respective the short-circuited end portions.

In the present invention, the internal ground electrode is formed in the dielectric layer between the resonator and the ground electrode to be disposed in the opposed facing relationship to a portion of the resonator, the ground electrode being disposed in the opposed facing relationship to the entire surface of the resonator with the dielectric layer interposed therebetween. Therefore, the portion of the resonator in the opposed facing relationship to the internal ground electrode become closer to the ground, thereby inducing a capacitance between the resonator and the internal ground electrode. The capacitance thus induced is added to the capacitance of parallel resonance circuit, which is obtained by expressing the resonator with lumped constants. Thus, assuming that the resonance frequency of the parallel resonance circuit is not changed, then inductance of the parallel resonance circuit becomes small. As a result, the length of the resonator becomes shorter, and therefore the entire length of the transmission line filter is also reduced.

Further, when a plurality of resonators are used, the portions of the resonators which are in the opposed facing relationship to the internal ground electrode become closer to the ground, so that the degree of coupling between the portions and the ground increases. Therefore, the degree of coupling between the portions of the resonators which are in the opposed facing relationship to the internal ground electrode is reduced. Therefore, the resonators become coupled with each other mainly between the portions which are not in the opposed facing relationship to the internal ground electrode. This means that the electrical length of each of the resonators becomes short. When the electrical length of each resonator becomes short in this way, the reactance of a distributed constant element coupling the resonators with each other is also reduced. Thus, the degree of coupling between the resonators increases, thereby making the filter bandwidth broader.

Moreover, by forming the internal ground electrode in the dielectric layer to be disposed in the opposed facing relationship to the open-circuited end portion of the resonator and by making conductor width of the resonator at the open-circuited end portion greater than that at the short-circuited end portion, the value of capacitance induced between the open-circuited end portion of the resonator and the internal ground electrode becomes greater as compared with the case where the conductor width of the resonator at the open-circuited end portion is the same as that at the short-circuited end portion. In addition, capacitance induced between the open-circuited end portion of the resonator and the internal ground electrode are added to capacitance of parallel resonance circuit which is obtained by expressing the resonator with the lumped-constant equivalent circuit. Thus, assuming that the resonance frequency of the parallel resonance circuits is not changed, then inductance of the parallel resonance circuit become much smaller. As a result, the length of each of the resonator becomes much shorter, and therefore the entire length of the transmission line filter also becomes much shorter.

If the conductor widths of the resonators at the open-circuited end portions are set broader than those at the short-circuited end portions without forming the internal ground electrode, intervals between the adjacent open-circuited end portions of the resonators are reduced, so that the degree of capacitive coupling between the adjacent resonators becomes too large. As a result, a problem arises that the degree of inductive coupling between the adjacent resonators is reduced so much that the filter bandwidth becomes too narrow. When such a problem is tried to be avoided by not increasing the degree of capacitive coupling between the respective adjacent resonators, the intervals between the adjacent resonators at the open-circuited end portions should be increased, thus causing another problem that the filter becomes greater in size.

On the other hand, as in the present invention, by forming the internal ground electrode in dielectric layer and in the opposed facing relationship to the open-circuited end portions of the resonators, the open-circuited end portions of the resonators become closer to the ground, thereby increasing the degree of coupling between the open-circuited end portions and the ground. As a result, the degree of coupling between the open-circuited end portions of the resonators which are in the opposed facing relationship to the internal ground electrode is reduced. Thus, even though the conductor widths of the resonators at the open-circuited end portions are set broader than those at the short-circuited end portions so that the intervals between the adjacent open-circuited end portions of the resonators are reduced, the degree of coupling between the open-circuited end portions of the resonators which are in the opposed facing relationship to the internal ground electrodes remains weak, and therefore the resonator becomes coupled with each other mainly between the portions which are not in the opposed facing relationship to the internal ground electrode. This means that the electrical length of each of the resonators becomes short. When the electrical length of the resonators becomes short in this way, the reactance of each distributed constant element coupling the adjacent resonators with each other is also reduced. As a result, the degree of coupling between the resonators increases, thereby making the filter bandwidth broader rather than making the filter bandwidth narrower. Thus, because the intervals between the open-circuited end portions of the resonators can be reduced without making the filter bandwidth narrower, even though the conductor widths of the open-circuited end portions of the resonators are made broader than those of the short-circuited end portions, an increase in the size of the filter can be controlled by reducing the intervals between the open-circuited end portions of the resonators.

According to still another embodiment of the present invention, there is provided a transmission line filter, comprising:

a first ground electrode;

a dielectric layer disposed on the first ground electrode;

a first resonator disposed in the dielectric layer, having an end portion short-circuited to the first ground electrode and an open-circuited end portion and having a first main surface;

a second resonator disposed in the dielectric layer and inductively coupled to the first resonator, the second resonator having an end portion short-circuited to the first ground electrode and an open-circuited end portion and having a first main surface;

a first coupling adjusting electrode disposed in the dielectric layer in an opposed facing relationship both to a portion of the first main surface of the first resonator and to a portion of the first main surface of the second resonator.

The transmission line filter preferably further comprises a second ground electrode disposed on the dielectric layer.

In the transmission line filter, the first resonator preferably has a second main surface in an opposed relationship to its the first main surface, and the transmission line filter may further comprise:

a third resonator disposed in the dielectric layer and inductively coupled to the first resonator, the third resonator having an end portion short-circuited to the first ground electrode and an open-circuited end portion and having a first main surface, and the first resonator being disposed between the second resonator and the third resonator; and a second coupling adjusting electrode disposed in the dielectric layer in an opposed facing relationship both to a portion of the second main surface of the first resonator and to a portion of the first main surface of the third resonator.

Preferably, the transmission line filter further comprises an internal ground electrode disposed in the dielectric layer in an opposed facing relationship to the first resonator at its open-circuit end portion and in an opposed facing relationship to the second resonator at its the open-circuit end portion. The internal ground electrode is preferably disposed in an opposed facing relationship to the third resonator at its open-circuit end portion.

Because the first coupling adjusting electrode is disposed in the opposed facing relationship to the portion of the first main surface of the first resonator and to the portion of the first main surface of the second resonator, capacitances are respectively induced between the first coupling adjusting electrode and the respective first and second resonators. Because the combined capacitance of these capacitances is connected in parallel to the inductance induced between the first and second resonators, the inductive coupling between the first and second resonators can be controlled by the combined capacitance. Therefore, the degree of inductive coupling between the first and second resonators can be adjusted by adjusting the value of the combined capacitance, thereby making it possible to obtain a filter having a desired bandwidth. The value of the combined capacitance can be easily adjusted by varying an area where the first resonator and the first coupling adjusting electrode overlap each other and the distance therebetween, and an area where the second resonator and the first coupling adjusting electrode overlap each other and the distance therebetween.

Further, by forming the second coupling adjusting electrode, which is disposed in an opposed facing relationship to the first and third resonators, to be disposed in the opposed facing relationship to the portion of the second main surface of the first resonator which is in the opposed relationship to the first main surface of the first resonator to which the first coupling adjusting electrode is in the opposed facing relationship, the first and second coupling adjusting electrodes are respectively formed in the dielectric layers respectively disposed on opposite side of the first resonator. As a result, the overlapped area of the first coupling adjusting electrode and the first resonator and the overlapped area of the second coupling electrode and the first resonator can be independently increased, thereby making it possible to create large capacitances between the first coupling adjusting electrode and the first resonator and between the second coupling adjusting electrode and the first resonator, respectively. Forming the large capacitances in this way makes it easier to adjust the inductive coupling induced between the resonators by the capacitances to obtain easily a filter having a desired bandwidth.

However, by further providing the internal ground electrode in the opposed facing relationship to the open-circuited end portions of resonators, capacitances induced between open-circuited end portions and the internal ground electrode are added to the capacitances of parallel resonance circuits, which are obtained by expressing the resonators with the lumped-constant equivalent circuit. Thus, assuming that the resonance frequency of the parallel resonance circuits is not changed, then the inductance of the parallel resonance circuits becomes smaller. As a result, the length of each of the resonators becomes shorter and therefore the entire length of the transmission line filter can also be made shorter.

In this case, a problem arises that when the area where the internal ground electrode overlaps the resonators is increased to reduce the transmission line filter in size, the resonators become more strongly inductively-coupled to each other, thereby making the filter bandwidth too broad. In the present invention, however, because the coupling adjusting electrode is disposed in the opposed facing relationship to the two resonators, the inductive coupling between the resonators can be controlled by means of the capacitances respectively induced between the coupling adjusting electrode and the respective resonators, thereby making it possible to obtain a filter having a desired bandwidth. Thus, a transmission line filter whose bandwidth can be prevented from being made too broad even when the transmission line filter is reduced in size, can be obtained by providing the internal ground electrode disposed in the opposed facing relationship to the open-circuited end portions of the resonators and by providing the coupling adjusting electrode disposed in the opposed facing relationship to the two resonators.

As described above, in the present invention, by providing the coupling adjusting electrode in the opposed facing relationship to the two resonators, the combined capacitance of the capacitances induced between the respective resonators and the coupling adjusting electrode, is connected in parallel to the inductance induced between the resonators, thereby inserting a parallel resonance circuit composed of the capacitance and the inductance between the resonators. Because the impedance of the parallel resonance circuit composed of the capacitance and the inductance varies from inductive to capacitive at points before and after the parallel resonance point, the coupling between the resonators can be made either inductive or capacitive by adjusting the values of the capacitances induced between the resonators and the coupling adjusting electrode. Let's now consider the case where the coupling between the resonators is made inductive, then, a filter having the attenuation peak on the high-frequency side can be obtained because the parallel resonance point exists on the high-frequency side of the passband. When, on the other hand, the coupling between the resonators is made capacitive, then a filter having the attenuation peak on the low-frequency side can be obtained because the parallel resonance point exists on the low-frequency side of the passband. Thus, the attenuation characteristics of the filters can be improved even in either case.

BRIEF DESCRIPTION OF THE DRAWINGS

The above and further objects, features and advantages of the present invention will become more apparent from the following detailed description taken in conjunction with the accompanying drawings, wherein.

DESCRIPTION OF THE PREFERRED EMBODIMENTS

First Embodiment

Figure 1:
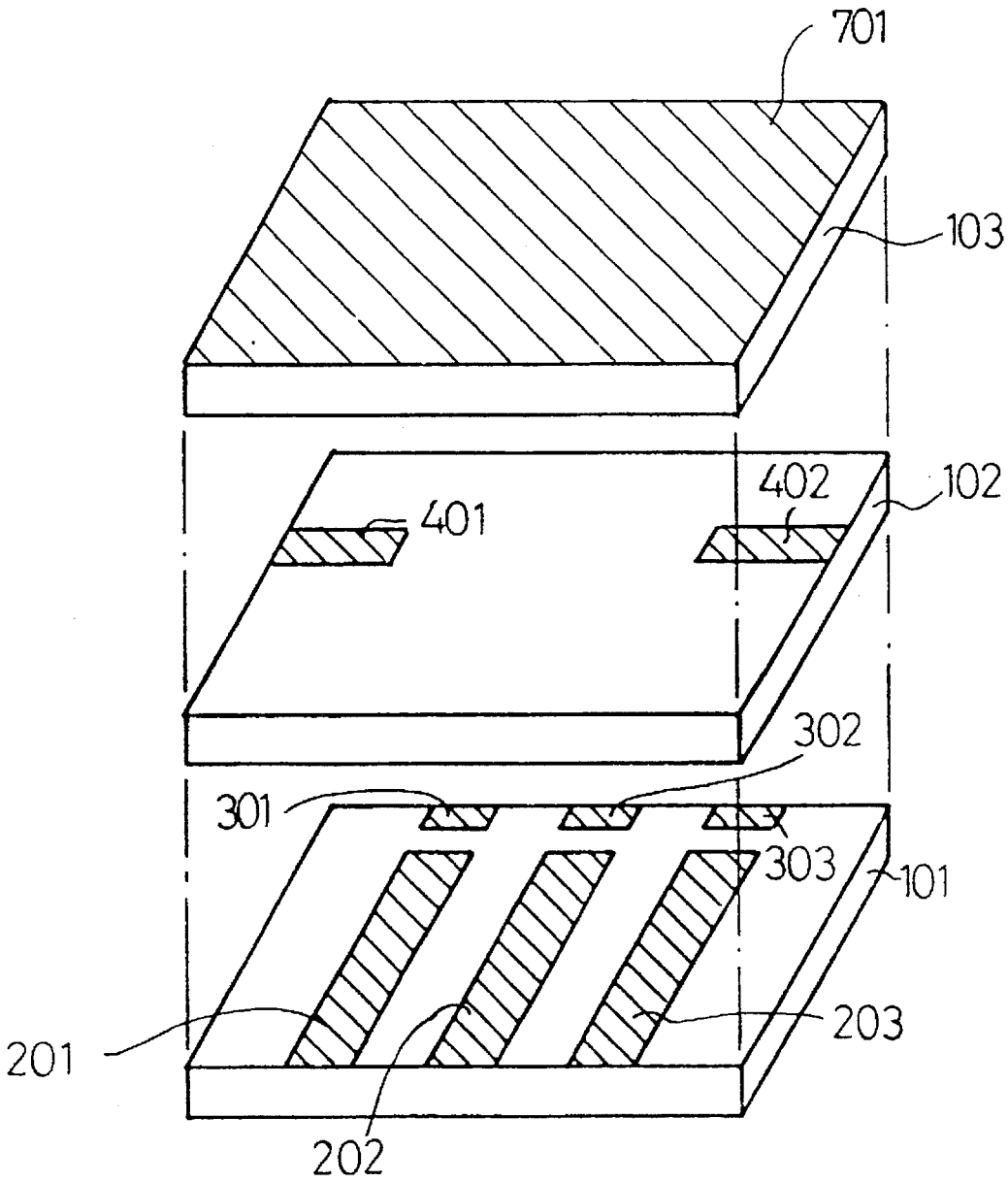
FIG. 1 is a schematic exploded perspective view showing a transmission line filter conceived by the present inventors.
Figure 2:
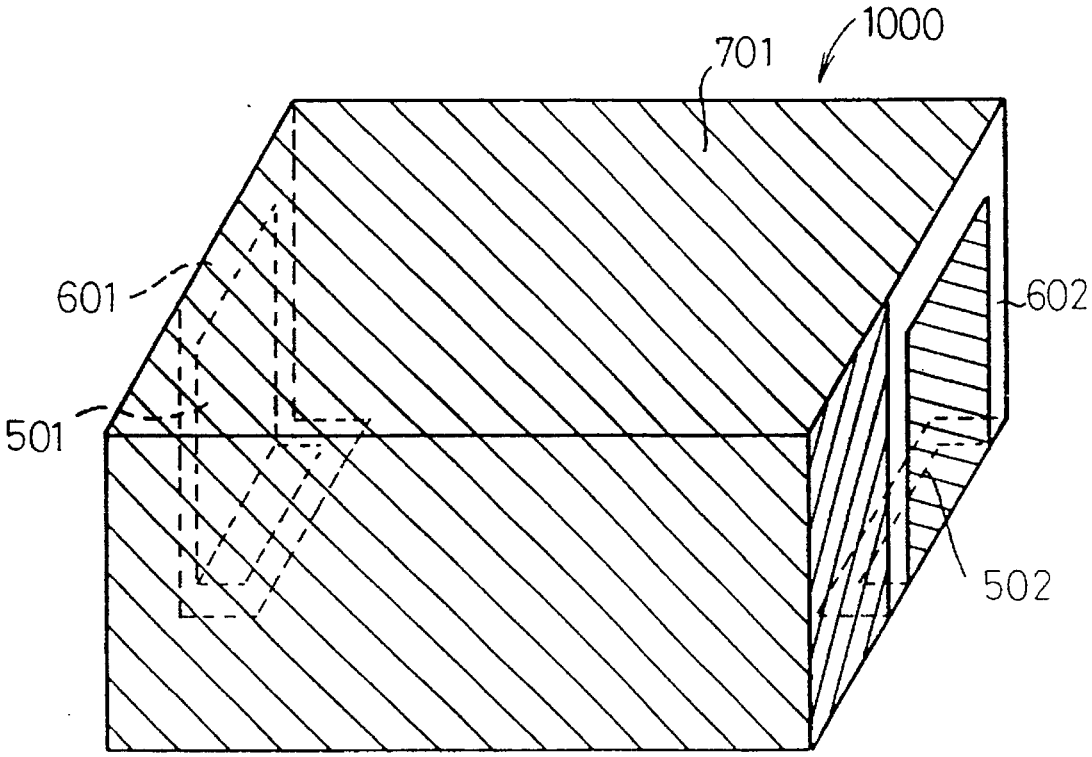
FIG. 2 is a perspective view showing the transmission line filter conceived by the present inventors.
Figure 3:
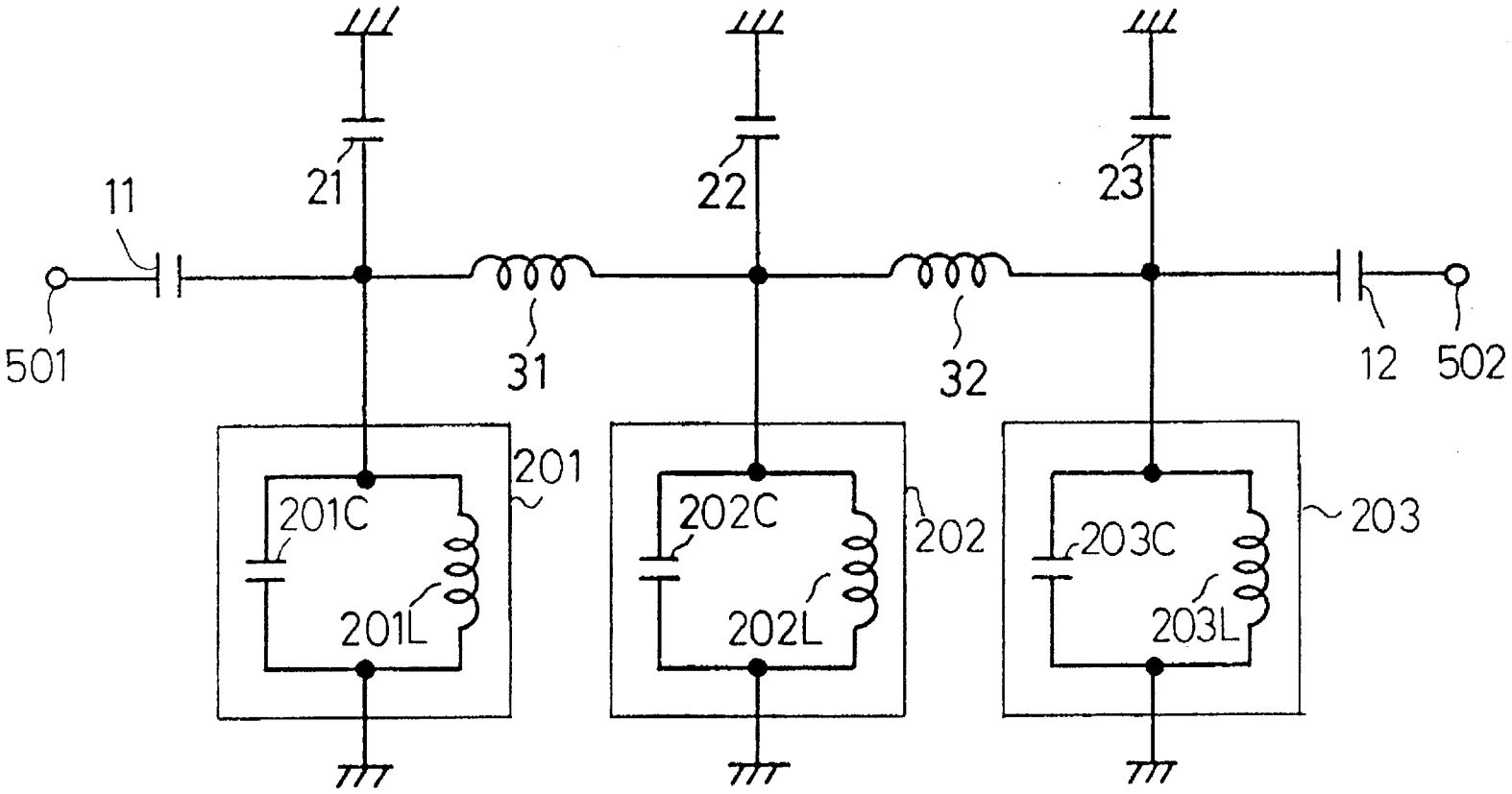
FIG. 3 is an equivalent circuit diagram of the transmission line filter conceived by the present invention.
Figure 4:
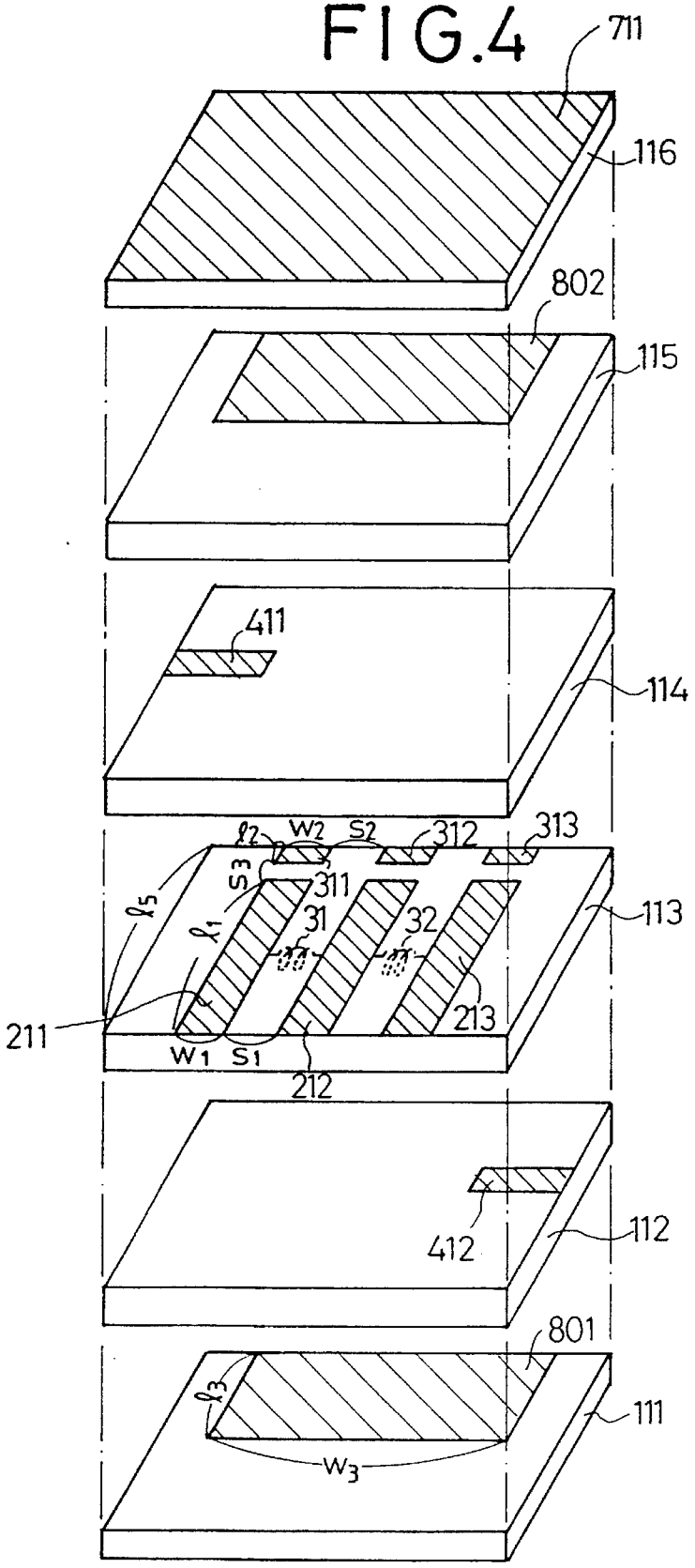
FIG. 4 is a schematic exploded perspective view showing a transmission line filter of a first embodiment of the present invention.
Figure 5:
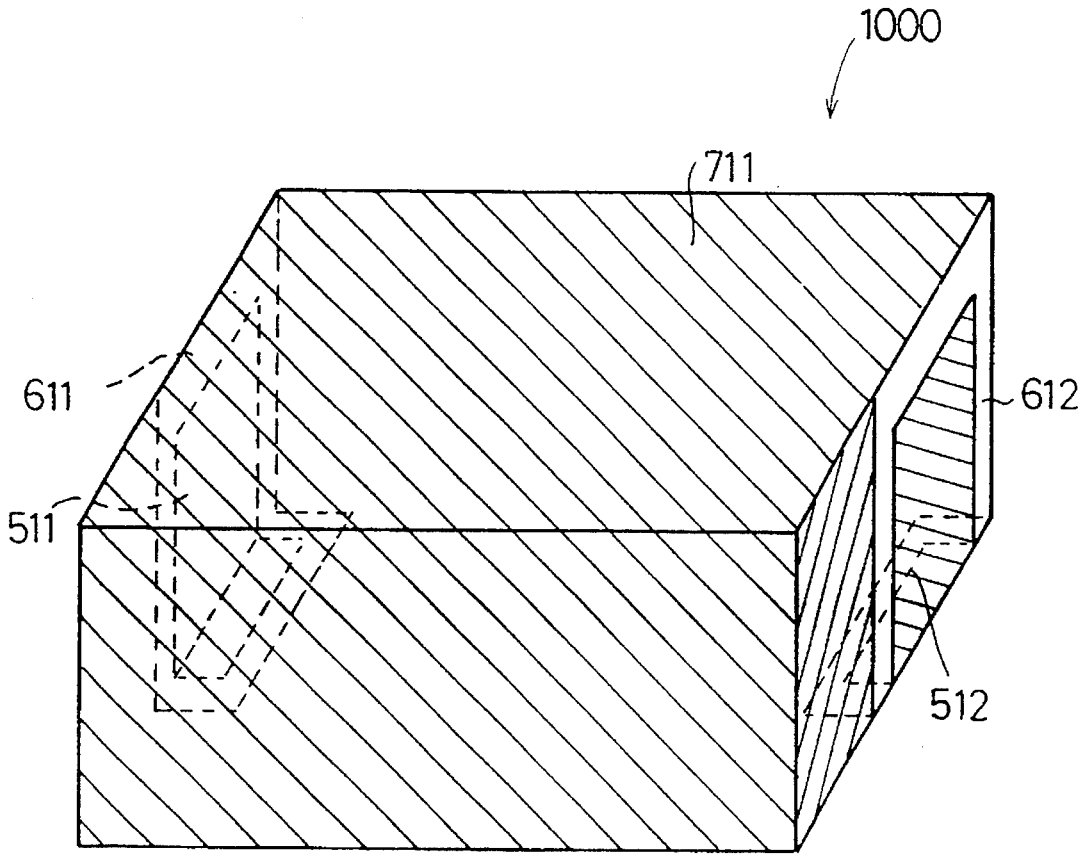
FIG. 5 is a perspective view showing the transmission line filter of the first embodiment of the present invention.
Figure 6:
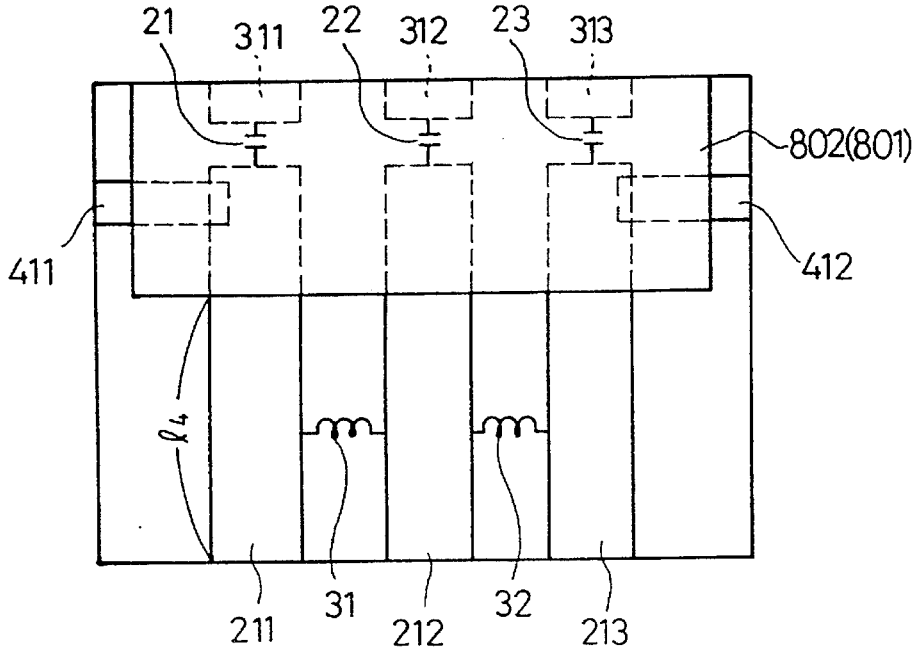
FIG. 6 is a plan view showing the structure of a principal part of the transmission line filter of the first embodiment of the present invention.
Figure 7:
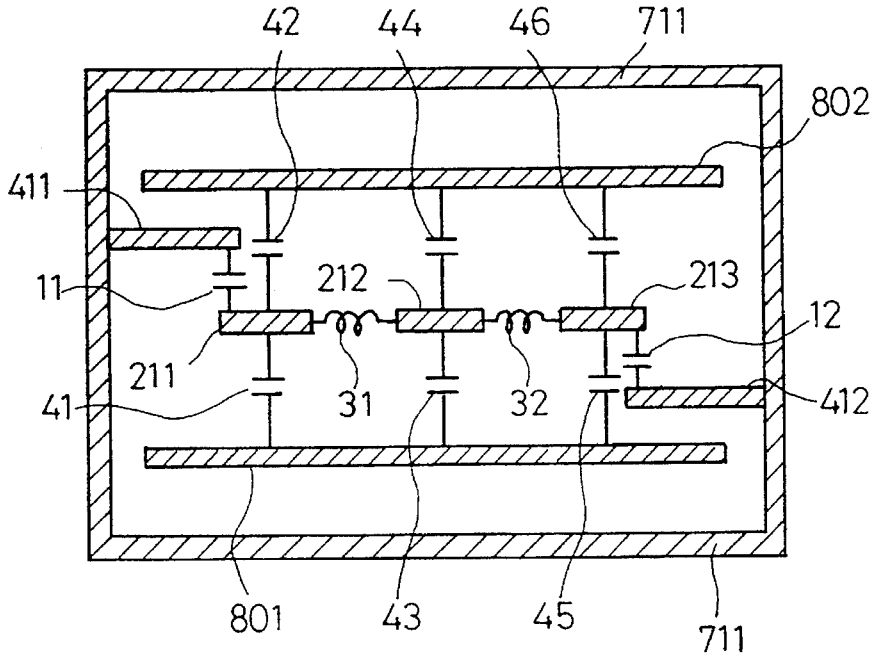
FIG. 7 is a cross-sectional view showing the structure of the principal part of the transmission line filter of the fist embodiment of the present invention.

FIG. 4 is a schematic exploded perspective view showing a transmission line of a first embodiment of the present invention, FIG. 5 is a perspective view showing the present embodiment, and FIGS. 6 and 7 are respectively a plan view and a cross-sectional view showing the structure of a principal part of the present embodiment.

An internal ground electrode 801 is formed on a dielectric layer 111. The ground electrode 801 overlaps the open-circuited end portions of resonators 211, 212, 213 with dielectric layers 112, 113 interposed therebetween and has one end connected to a ground electrode 711. Incidentally, the ground electrode 711 is to be formed later on the lower surface of the dielectric layer 111.

An output electrode 412 which overlaps the resonator 213 on the output side with the dielectric layer 113 interposed therebetween, is formed on the dielectric layer 112.

The resonators 211 through 213, each of which has one end connected to the ground electrode 711, constituting ¼ wavelength stripline resonators, are formed on the dielectric layer 113. Further, electrodes 311 through 313, each of which has one end connected to the ground electrode 711 and the other end spaced at predetermined intervals away from the open-circuited end portions of the resonators 211 through 213 and opposed to the resonators 211 through 213 respectively, are formed on the dielectric layer 113. A comb-line filter is constructed by making use of the distributed coupling between the respective adjacent resonators 211 through 213. The resonator 211 is an input-side resonator and the resonator 213 is an output-side resonator. Inductive couplings between the resonators are equivalently expressed by inductances 31, 32.

An input electrode 411, which overlaps the resonator 211 with a dielectric layer 114 interposed therebetween, is formed on the dielectric layer 114.

An internal ground electrode 802, which overlaps the open-circuited end portions of the resonators 211 through 213 with the dielectric layer 114 and a dielectric layer 115 interposed therebetween and has one end connected to the ground electrode 711, is formed on the dielectric layer 115.

A dielectric layer 116, an upper surface of which the ground electrode 711 is to be formed on, is stacked on the dielectric layer 115. Then, the dielectric layers 111 through 116 are combined into a single unit, followed by being fired, thereby producing a layered product 1000.

As shown in FIG. 5, the ground electrode 711 is formed on the upper and lower surfaces of the layered product 1000 and the side surfaces thereof other than input and output terminal portions 611 and 612. Further, an input terminal 511, which is insulated from the ground electrode 711 and connected to the input electrode 411, is formed in the input terminal portion 611 formed on one side surface of the layered product 1000. Furthermore, an output terminal 512, which is insulated from the ground electrode 711 and connected to the output electrode 412, is formed in the output terminal portion 612 formed on another side surface of the layered product 1000.

FIGS. 6 and 7 are a plan view and a cross-sectional view, respectively, showing a spatial structure of the resonators 211 through 213, the electrodes 311 through 313, the input electrode 411, the output electrode 412, the internal ground electrodes 801, 802 and the ground electrode 711.

There is a region where the resonator 211 overlaps the input electrode 411 with the dielectric layer interposed therebetween, and therefore the resonator 211 and the input electrode 411 are capacitively coupled with each other by a capacitance 11. Likewise, there is a region where the resonator 213 overlaps the output electrode 412, and therefore a capacitance 12 is induced at the overlapped region. Further, capacitances 21, 22, 23 are formed between the open-circuited end portions of the resonators 211, 212, 213 and the electrodes 311, 312, 313, respectively.

Capacitances 41, 42 are induced between the resonator 211 and the internal ground electrode 801 and between the resonator 211 and the internal ground electrode 802, respectively. Capacitances 43, 44 are induced between the resonator 212 and the internal ground electrode 801 and between the resonator 212 and the internal ground electrode 802, respectively. Further, capacitances 45, 46 are induced between the resonator 213 and the internal ground electrode 801 and between the resonator 213 and the internal ground electrode 802, respectively.

Due to the existence of the capacitances 21, 23 and 41 through 46, the resonators 211 through 213 are coupled with one another by the inductances 31, 32, thereby forming a comb-line type filter.

Figure 8:
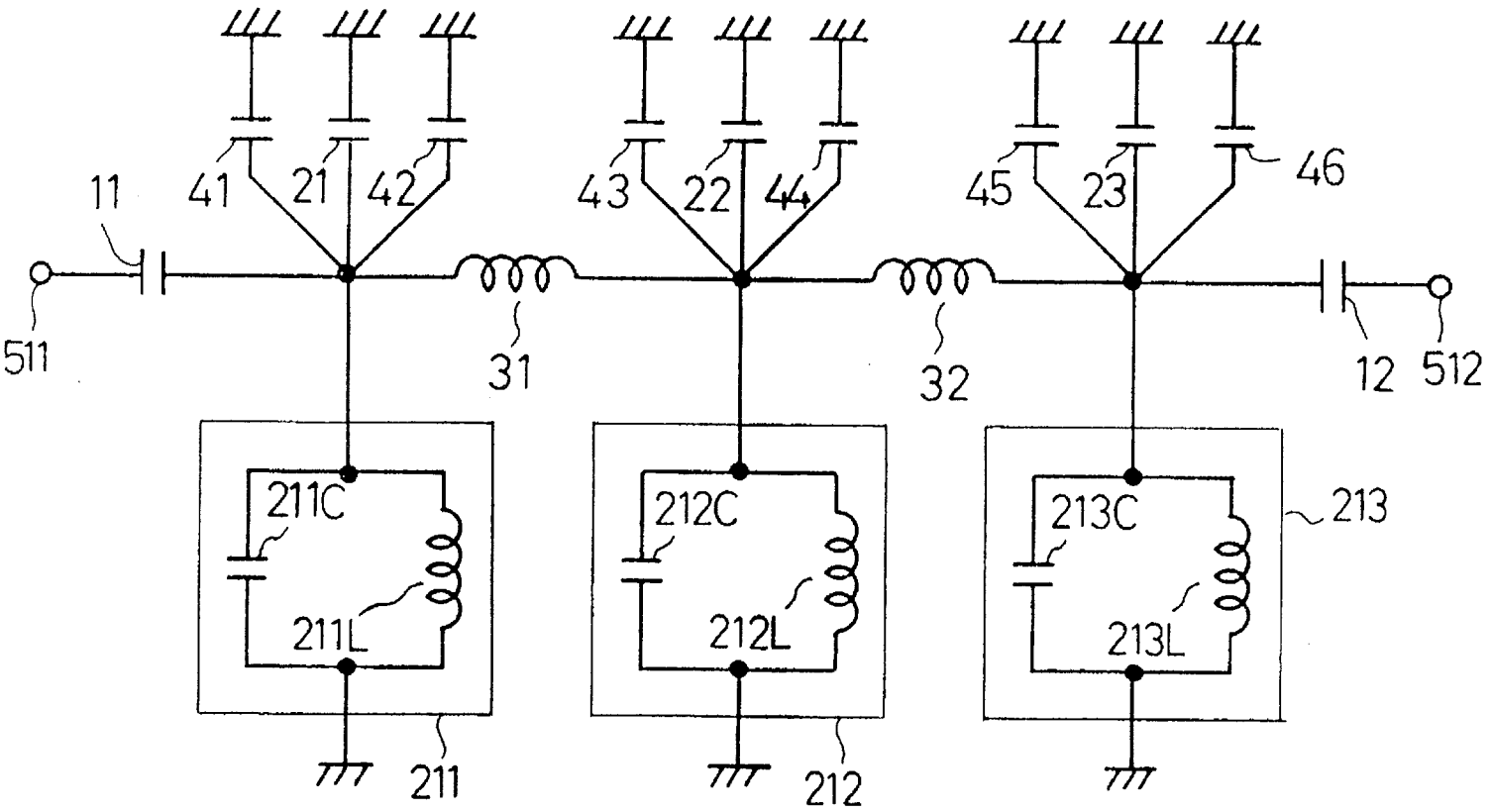
FIG. 8 is an equivalent circuit diagram of the first embodiment of the present invention.

FIG. 8 shows an equivalent circuit of a transmission line filter constructed as described above. Incidentally, capacitances 211C, 212C, 213C and inductances 211L, 212L, 213L of parallel resonance circuits respectively correspond to capacitances and inductances obtained by expressing the resonators 211, 212, 213 with the lumped-constant equivalent circuit.

Effect of the internal ground electrodes employed in the present embodiment will now be explained.

Figure 9:
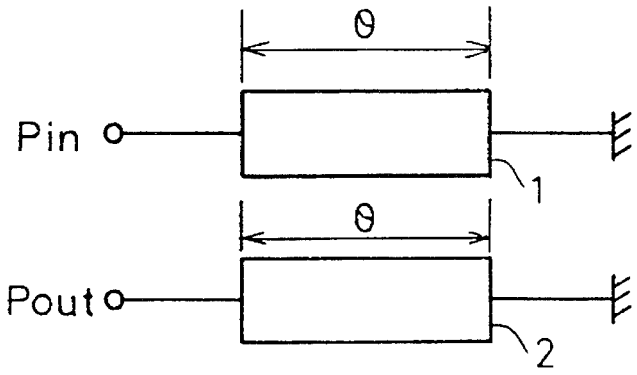
FIG. 9 is a view for explaining a comb-line type resonator.
Figure 10:
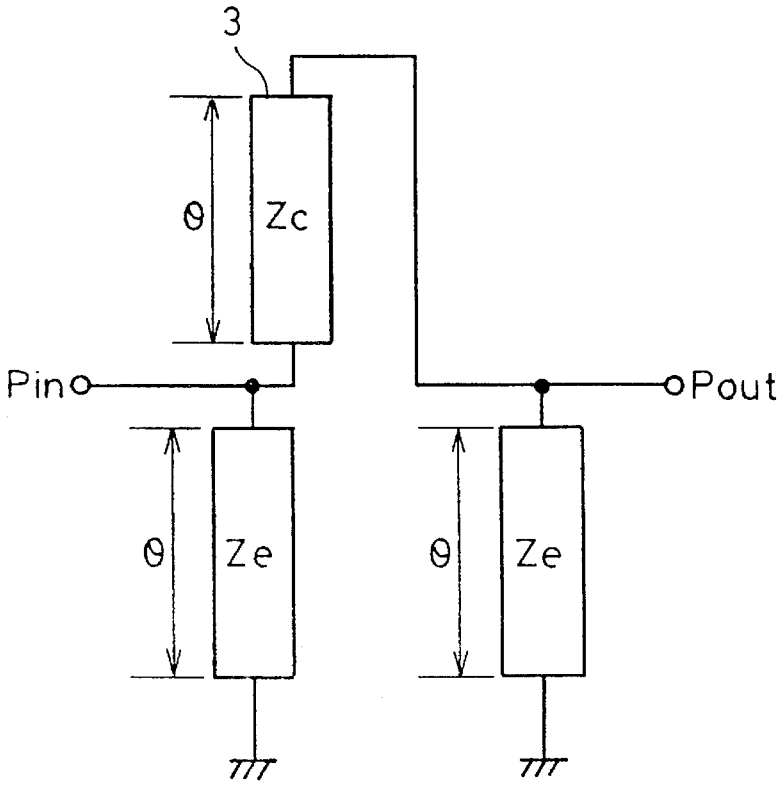
FIG. 10 is an equivalent circuit diagram showing a wiring shown in FIG. 9.

Let's first consider the case where two comb-line type resonators 1, 2 exist as shown in FIG. 9. Both of the electrical lengths of the resonators 1, 2 are θ. FIG. 10 is a equivalent circuit diagram of a wiring of the comb-line type resonators shown in FIG. 9. Assuming now that an even-mode impedance of each of the resonators 1, 2 is $Z_e$ and an odd-mode impedance thereof is $Z_o$, a characteristic impedance $Z_c$ of a distributed constant element 3 coupling the resonators 1 and 2 with each other in a distributed-constant manner can be expressed as follows:

$$Z_c=1/[(1/Z_o-1/Z_e)/2].$$

Further, an impedance Z of the characteristic impedance $Z_c$ as seen from an open end of a line is represented as $$Z=jZ_c \tan \theta.$$

Figure 11:
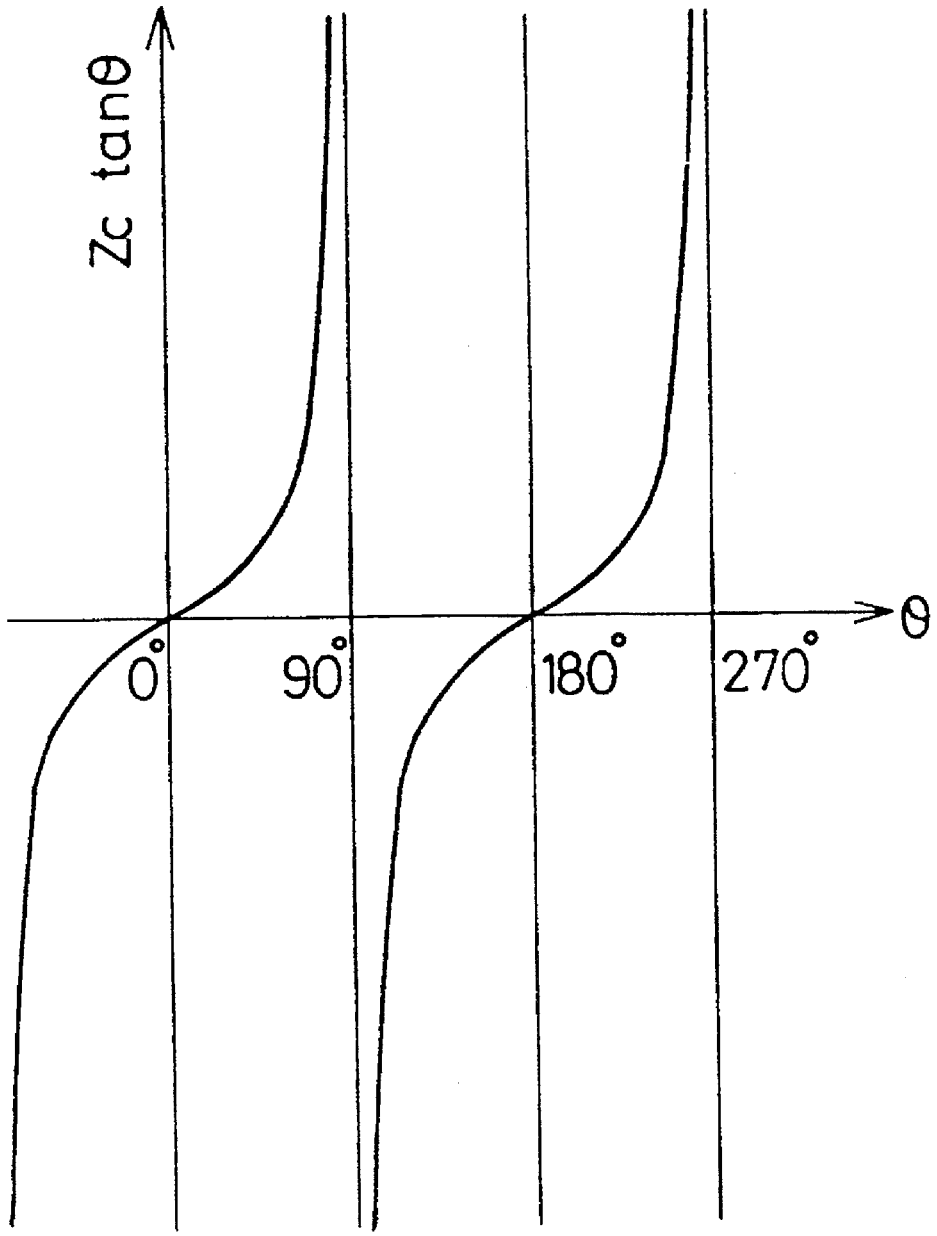
FIG. 11 is a diagram for describing the relationship between the reactance of the characteristic impedance of a distributed constant element 3 in the equivalent circuit diagram shown in FIG. 10 and the electrical length of the distributed constant element 3.

FIG. 11 shows the, relationship between the reactance $Z_c$ tan θ of the impedance Z and the electrical length θ. When θ=90° (i.e., ¼ wavelength), the reactance $Z_c$ tan θ of the distributed constant element 3 becomes ∞. It is, therefore, understood that the electrical coupling does not exist between the resonators 1 and 2. When the electrical length θ becomes shorter than the ¼ wavelength, that is, when 0<θ<90°, tan θ becomes a finite value. Thus, the reactance $Z_c$ tan θ of the distributed constant element 3 also becomes a finite value, so that the resonator 1 becomes electrically coupled to the resonator 2. The more the value of θ becomes small, the more the reactance $Z_c$ tan θ becomes small, resulting in that the resonator 1 becomes firmly coupled with the resonator 2. In this case, that is, when 0<θ<90°, the value of the $Z_c$ tan θ is positive. Therefore, the distributed constant element 3 is expressed as an inductance.

Referring back to FIGS. 6, 7 and 8, by partly adding the internal ground electrodes 801, 802 to the open-circuited end portion side of the resonators 211 through 213. The portions of the resonators 211 through 213, which are located on the open-circuited end portion side thereof and overlap the internal ground electrodes 801, 802, become closer to the ground, thereby increasing the degree of coupling between the portions and the ground. Therefore, the degree of coupling between the portions of resonators 211 through 213 which overlap the internal ground electrodes 801, 802, is reduced. Consequently, the coupling between the adjacent resonators 211 through 213 is mainly effected at the regions where they do not overlap the internal ground electrodes 801, 802. This means that the coupling electrical length θ of each of the resonators 211 through 213 is equal to the length of each of the portions of the resonators 211 through 213, which do not overlap with the internal ground electrodes 801, 802. When the electrical length θ of each of the resonators 211 through 213 is thus shortened, the reactance $Z_c$ tan θ of the distributed constant element 3 coupling the resonators 211 through 213 with one another is also reduced. Therefore, the resonators 211 through 213 are firmly coupled with one another, thereby making it possible to make the filter bandwidth broader.

Because the electrodes 311 through 313 are provided, the capacitances 21 through 23 are respectively induced between the respective resonators 211 through 213 and the ground. Moreover, by further providing the internal ground electrodes 801, 802, the capacitances 41 and 42, 43 and 44, and 45 and 46 are induced between the resonator 211 and the internal ground electrode 801, 802, between the resonator 212 and the internal ground electrode 801, 802 and between the resonator 213 and the internal ground electrode 801, 802, respectively. As a result, these capacitances 41 and 42, 43 and 44 and 45 and 46 are also respectively added between the respective resonators 211 through 213 and the ground. Therefore, the total capacitance of the respective parallel resonant circuits shown in FIG. 8 is equal to the sum of the capacitances 211C, 212C, 213C obtained by respectively expressing the resonators 211 through 213 with the lumped-constant equivalent circuit and these added capacitances 41 through 46. Assuming that the resonance frequency of the resonators 211 through 213 are not changed, then the inductances of the parallel resonance circuits become small. Thus, the length of each of the resonators 211 through 213 becomes shorter, and therefore the entire length of the transmission line filter also becomes shorter. Further, the input electrode 411 and the output electrode 412 are disposed with the resonators 211 through 213 interposed therebetween. Thus, the input electrode 411 and the output electrode 412 are electrostatically shielded by the resonators 211 through 213, thereby substantially eliminating the stray capacitance between the input and output electrodes 411 and 412. As a result, the steepness of a frequency characteristic of a bandpass filter is also improved.

Second Embodiment

Figure 12:
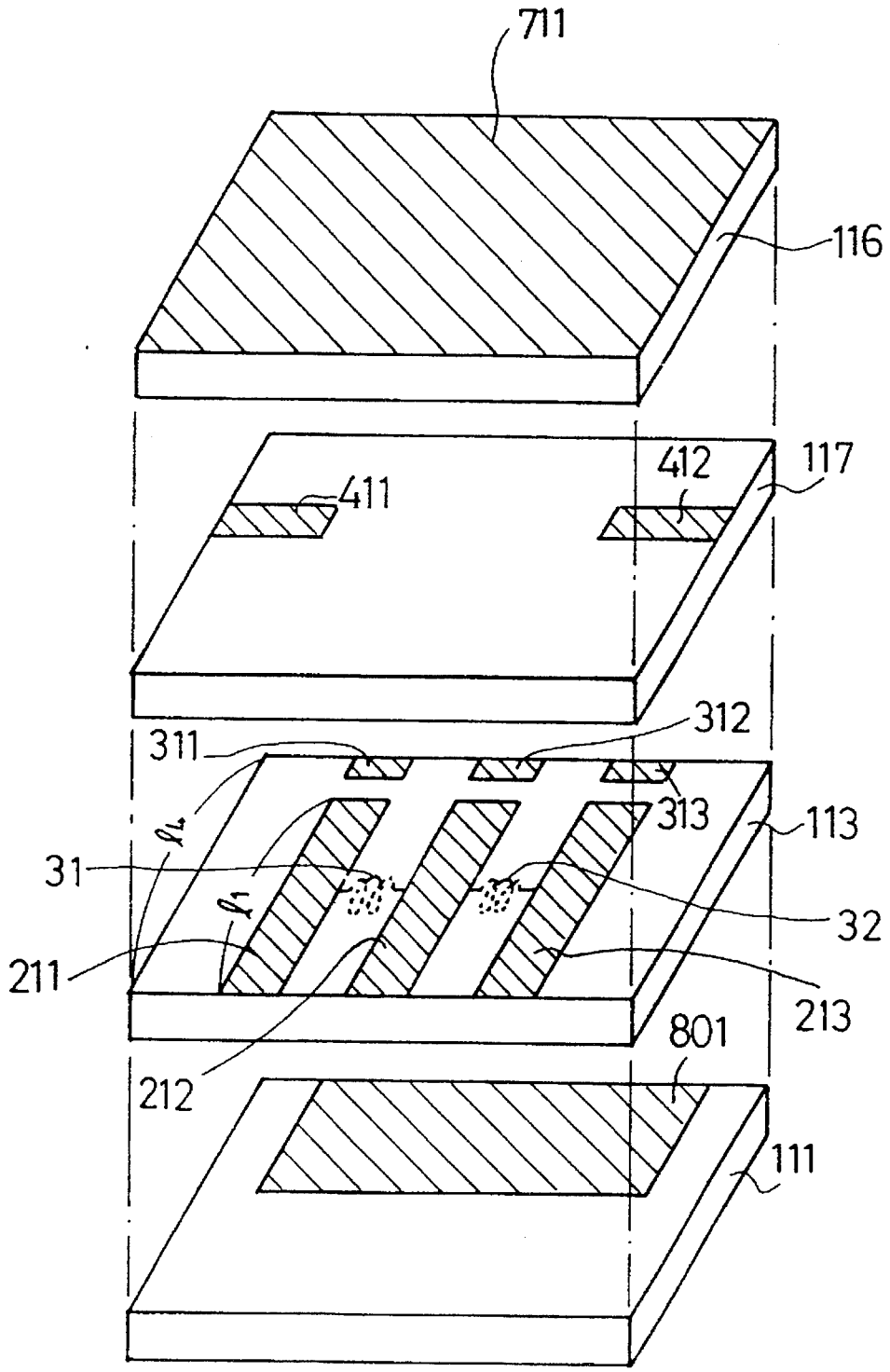
FIG. 12 is a schematic exploded perspective view showing a transmission line filter of a second embodiment of the present invention.

FIG. 12 is a schematic exploded perspective view showing the second embodiment of the present invention.

The present embodiment differs from the first embodiment in that only the internal ground electrode 801 is disposed on the dielectric layer 111 under the resonators 211 through 213, and the input electrode 411 and the output electrode 412 are provided only on a dielectric layer 117 to be stacked on the resonators 211 through 213 instead of separately providing the input and output electrodes 411, 412 above and below the resonators 211 through 213. However, others are identical in structure to those employed in the first embodiment.

Thus, even in the present embodiment, the relationship between the internal ground electrode 801 and the resonators 211 through 213 is identical to that in the first embodiment. Therefore, the resonators 211 through 213 are firmly coupled to one another so as to bring a filter characteristic into a broad bandwidth. Further, since the capacitances 41, 43, 45 shown in FIGS. 7 and 8 are also added, the lengths of the resonators 211 through 213 become shorter, and therefore the entire length of the transmission line filter is also reduced. Since, however, in the second embodiment, only the internal ground electrode 801 exists under the resonators 211 through 213, the first embodiment, in which the internal ground electrodes are disposed above and below the resonators 211 through 213, can achieve a broader bandwidth of a filter characteristic and reduce the transmission line filter in size as compared with the second embodiment.

Third Embodiment

The third embodiment of the present invention will now be explained.

Figure 13:
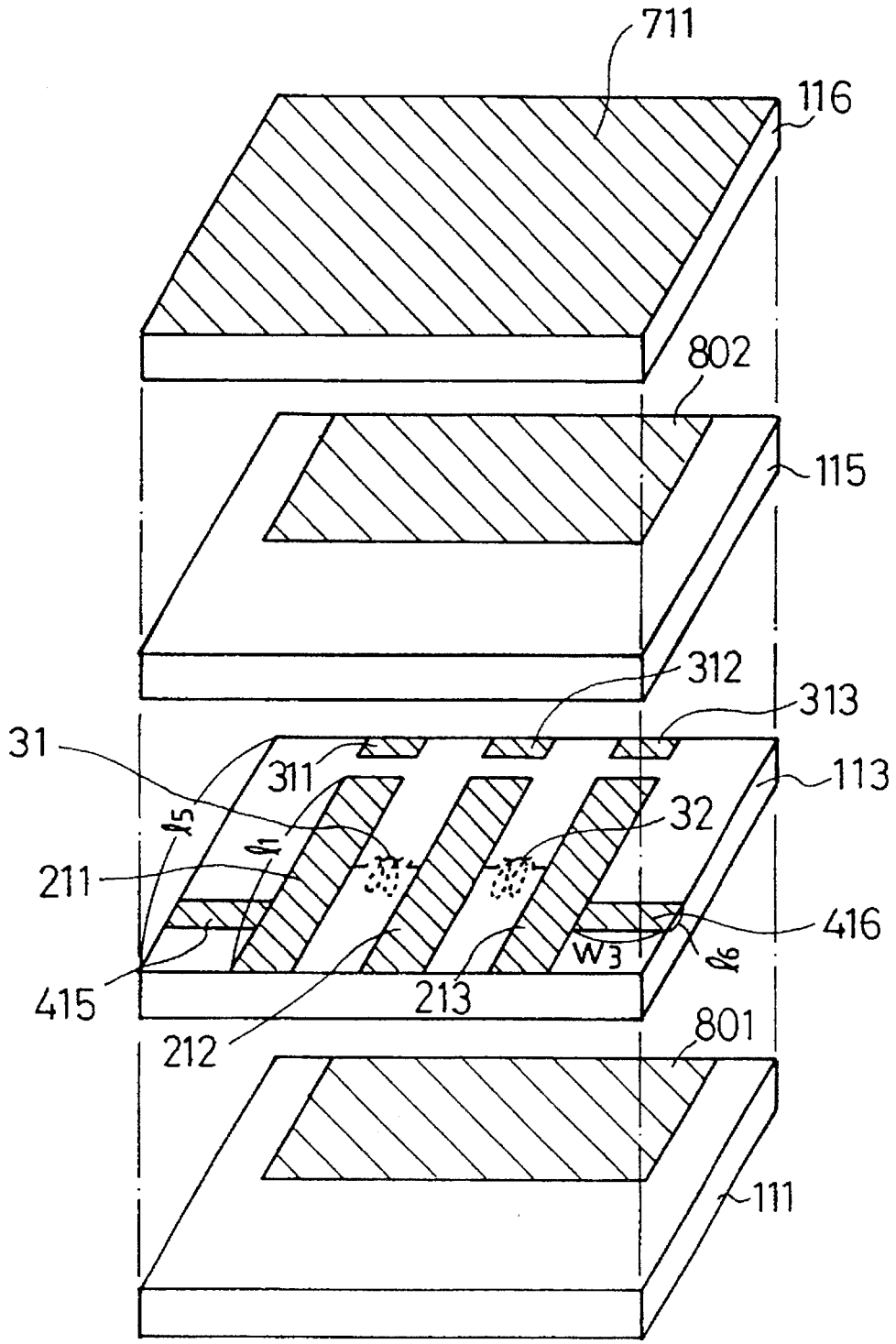
FIG. 13 is a schematic exploded perspective view showing a transmission line filter of a third embodiment of the present invention.
Figure 14:
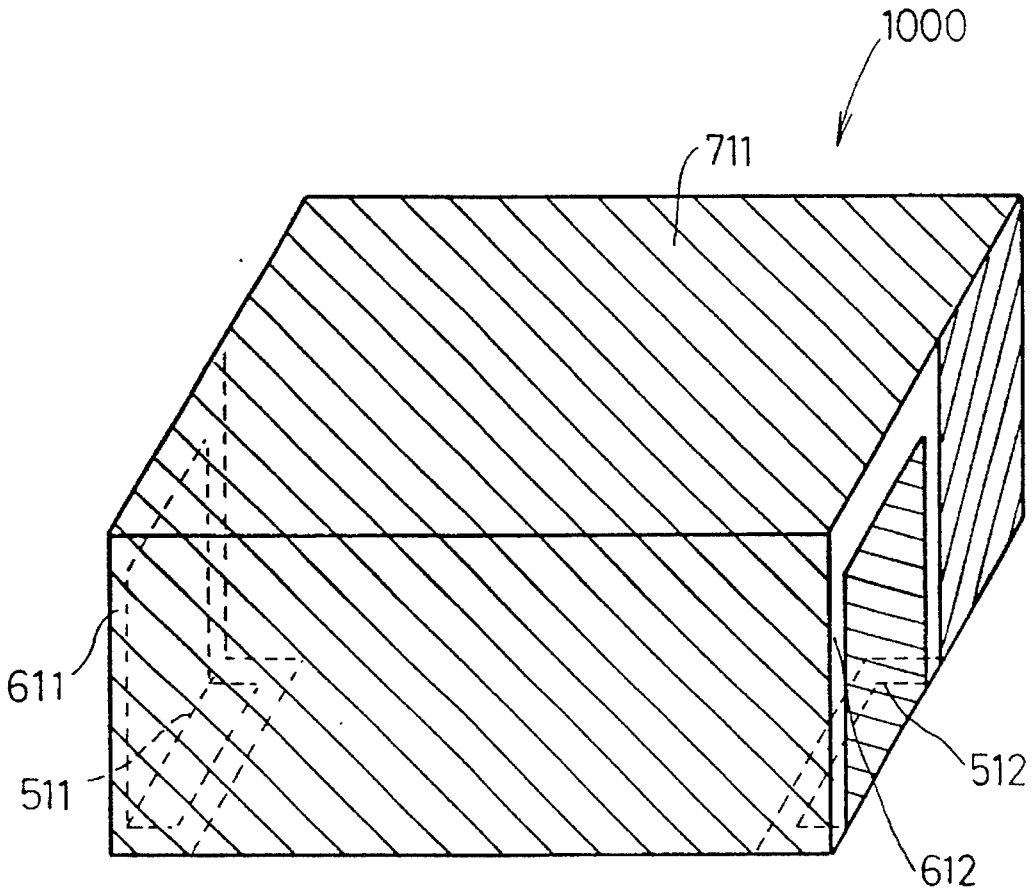
FIG. 14 is a perspective view showing the transmission line filter of the third embodiment of the present invention.

FIG. 13 is a schematic exploded perspective view showing the present embodiment. FIG. 14 is a perspective view showing the present embodiment.

The present embodiment is different from the first embodiment in that as an alternative to the input and output electrodes 411, 412 respectively capacitively coupled to the resonators 211, 213 in the first embodiment, input and output electrodes 415, 416 directly connected to resonators 211, 213 are formed on the dielectric layer 113 on which the resonators 211 through 213 are disposed, and are formed on the side at which the resonators 211, 213 are short-circuited to the ground electrode 711, and input terminal portions 611, 612 and input and output terminals 511, 512 are formed on the side of the resonators short-circuited to the ground electrode 711 instead of being formed on the side of the open-circuited end portions of the resonators 211 through 213. However, others are identical in structure to those employed in the first embodiment.

Thus, in the case of the present embodiment, the relationship between internal ground electrodes 801, 802 and the resonators 211 through 213 is identical to that in the first embodiment. Therefore, the resonators 211 through 213 is coupled firmly to one another so as to bring a filter characteristic into a broad bandwidth. Further, since the capacitances 41 through 46 shown in FIGS. 7 and 8 are also added, the lengths of the resonators 211 through 213 also become shorter, and therefore the entire length of the transmission line filter is also reduced.

A method of manufacturing the transmission line filter according to the first through third embodiments will next be explained. The present transmission line filter is constructed in such a manner that the resonators 211 through 213, the electrodes 311 through 313, the input electrode 411, the output electrode 4.12 and the internal ground electrodes 801, 802 are completely embedded in dielectrics. It is, therefore, desirable to use a material of low loss and low resistivity for the resonators 211 through 213, the electrodes 311 through 313, the input electrode 411 and the output electrode 412, and it is preferable to use Ag-system or Cu-system conductors which have a low resistivity.

A ceramic dielectric is preferably used for the dielectric material to be used in the transmission line filter, because the ceramic dielectric has high reliability and has a large dielectric constant $\epsilon_r$, which can reduce the size of the transmission line filter.

Preferred as the manufacturing method is one wherein conductive pastes are applied on green sheets containing ceramic powder so as to form electrode patterns thereon and thus processed respective green sheets are thereafter stacked and then fired, and conductors are formed integrally with the ceramic dielectrics in the form of a structure in which the conductors are embedded in the ceramic dielectrics.

When the Ag or Cu conductors are used, it is difficult to co-fire the conductors with normally-used dielectric materials, because the conductors have a low melting point. It is, therefore, necessary to use dielectric materials which can be fired at a temperature lower than the melting point (1100° C. or lower) of the conductors. Further, dielectric materials are preferably required to have a temperature characteristic (temperature coefficient) of the resonance frequency of a parallel resonance circuit which is ±50 ppm/°C. or less, in view of the nature of a device which serves as a microwave filter. Examples of such dielectric materials may include glass materials such as a mixture of cordierite glass powder, $TiO_2$ powder and $Nd_2Ti_2O_7$ powder, etc., materials obtained by adding a slight glass-forming component or a glass powder to a $BaO—TiO_2—RE_2O_3—Bi_2O_3$ composition (RE: rare earth components), and materials obtained by adding a slight glass powder to a dielectric ceramic powder of barium oxide-titanium oxide-neodymium oxide.

One example of the dielectric materials will be described. 73 wt % of glass powder composed of 18 wt % of MgO, 37 wt % of $Al_2O_3$, 37 wt % of $SiO_2$, 5 wt % of $B_2O_3$ and 3 wt % of $TiO_2$, 17 wt % of commercially available $TiO_2$ powder, and 10 wt % of $Nd_2Ti_2O_7$ powder were thoroughly mixed to obtain mixed powder. Incidentally, as the $Nd_2Ti_2O_7$ powder, one obtained by calcining $Nd_2O_3$ powder and $TiO_2$ powder at 1200° C. and thereafter grinding the resultant product was used. Then, an acrylic organic binder, a plasticizer, toluene and an alcoholic solvent were added to the mixed powder, and these materials were thoroughly mixed with alumina cobblestone to obtain a slurry. A green sheet having a thickness of 0.2 mm to 0.5 mm was produced using the slurry by the doctor blade method.

Next, in the case of the first embodiment, the conductor patterns shown in FIG. 4 were respectively printed on the green sheets by using a silver paste as a conductor paste. In order to adjust the thickness of the green sheets on which the conductor patterns were printed, necessary green sheets were thereafter stacked so as to form the structure shown in FIG. 4. The resultant product was fired at 900° C. to produce the layered product 1000.

The ground electrode 711 composed of a silver electrode, was printed on the upper and lower surfaces of the layered product 1000 and the side surfaces thereof other than the input terminal portion 611 and the output terminal portion 612 as shown in FIG. 5. Further, silver electrodes electrically insulated from the ground electrode 711 and respectively connected to the input electrode 411 and the output electrode 412, are printed in the input and output terminal portions 611, 612 as the input and output terminals 511, 512, respectively. The printed silver electrodes were fired at 850° C.

When, in the transmission line filter, the width $w_1$ of each of the resonators 211 through 213 was set to be 0.8 mm, the interval $S_1$ between the respective adjacent resonators 211 through 213 was set to be 1.2 mm, the length $l_1$ of each of the resonators 211 through 213 was set to be 4.5 mm, the width $W_2$ of each of the electrodes 311 through 313 was set to be 0.8 mm, the length $l_2$ of each of the electrodes 311 and 313 was set to be 0.5 mm, the length of the electrode 312 was set to be 0.2 mm, and the interval $S_2$ between the respective adjacent electrodes 311 through 313 was set to be 1.2 mm, the interval $S_3$ between each of the resonators 211, 213 and each of the electrodes 311, 313 opposed to the resonators 211, 213 was set to be 0.3 mm, the interval between the resonator 212 and the electrode 312 opposed to the resonator 212 was set to be 0.1 mm, the area where the input electrode 411 and the resonator 212 are opposed to each other was set to be 0.9 $mm^2$, the area where the output electrode 412 and the resonator 213 are opposed to each other was set to be 0.9 $mm^2$, the thicknesses of the dielectric layers 111, 112, 113, 114, 115, 116 were set to be 1.1 mm, 0.2 mm, 0.2 mm, 0.2 mm, 0.2 mm, 1.1 mm respectively, the width $W_3$ of each of the internal ground electrodes 801, 802 was set to be 5.2 mm, the length $l_3$ of each of the internal ground electrodes 801, 802 was set to be 1.8 mm, the area where the internal ground electrode 801 and each of the resonators 211 through 213 are opposed to each other was set to be 0.8 $mm^2$, the area where the internal ground electrode 802 and each of the resonators 211 through 213 are opposed to each other was set to be 0.8 $mm^2$, and the length $l_4$ of each of the portions of resonators 211 through 213 which is exposed from the internal ground electrodes 801, 802 was set to be 3.5 mm, for example, the outside dimension was 6.4 mm×5.3 mm×3 mm, the center frequency was 900 MHz, the bandwidth was 30 MHz, and the insertion loss was 2.3 dB or less. Further, the attenuation at a point where the frequency is higher than the center frequency by 35 MHz, was 14 dB.

For comparison, the following example was produced by using the green sheet employed in the first embodiment. That is, the length $l_1$ of each of the resonators 211 through 213 and the length $l_5$ of the transmission line filter were made longer than those employed in the first embodiment without providing the internal ground electrode 801 on the dielectric layer 111 and without providing the internal ground electrode 802 on the dielectric layer 115, and others were constructed in the same manner as the first embodiment. It was necessary to set the length $l_1$ of each of the resonators 211 through 213 to be 7.5 mm in order to make the center frequency the same value of 900 MHz as that of the first embodiment. Further, the length $l_5$ of the transmission line filter has reached 8.3 mm, i.e., it was increased by 2.0 mm as compared with the length $l_5$ of 5.3 mm of the first embodiment. Further, the bandwidth was 20 MHz, and narrower than the bandwidth of 30 MHz of the first embodiment. It is thus apparent from the first embodiment that the bandwidth was greatly improved and the size of the transmission line filter was also reduced.

In the case of the second embodiment, the conductor patterns shown in FIG. 12 were respectively printed on the green sheets employed in the first embodiment. In order to adjust the thickness of the green sheets on which the conductor patterns were printed, necessary green sheets were thereafter stacked so as to form the structure shown in FIG. 12. Afterwards, the resultant product was fired at 900° C. to produce the layered product 1000. Then, the ground electrode 711 and the input and output terminals 511, 512 were formed of silver electrodes, followed by being fired at 850° C.

When, in the transmission line filter fabricated in this way, the thicknesses of the dielectric layers 111, 113, 117, 116 were set to be 1.3 mm, 0.2 mm, 0.2 mm and 1.3 mm respectively, the length $l_1$ of each of the resonators 211 through 213 was set to be 5 mm, the length $l_5$ of the transmission line filter was set to be 5.8 mm and others were produced by the same method as the first embodiment, the center frequency was 900 MHz, the bandwidth was 28 MHz and the insertion loss was 2.2 dB or less.

For comparison, the following example was produced by using the green sheets employed in the second embodiment. That is, the length $l_1$ of each of the resonators 211 through 213 and the length $l_5$ of the transmission line filter were made longer than those employed in the second embodiment without providing the internal ground electrode 801 on the dielectric layer 111, and others are constructed in the same manner as the second embodiment. It was necessary to set the length $l_1$ of each of the resonators to be 7.5 mm in order to make the center frequency the same value of 900 MHz as that of the second embodiment. Further, the length $l_5$ of the transmission line filter has also reached 8.3 mm which was longer than 5.8 mm of the second embodiment. Furthermore, the bandwidth was 20 MHz, and narrower than that of the second embodiment. It is thus apparent from the second embodiment that the bandwidth was greatly improved and the size of the transmission line filter was also reduced.

In the case of the third embodiment, the conductor patterns shown in FIG. 13 were respectively printed on the green sheets employed in the first embodiment. In order to adjust the thickness of the green sheet on which the conductor patterns were printed, necessary green sheets were thereafter stacked so as to form the structure shown in FIG. 13. Afterwards, the resultant product was fired at 900° C. to produce the layered structure 1000. Then, the ground electrode 711 and the input and output terminals 511, 512 were formed of silver electrodes, followed by being fired at 850° C.

When, in the transmission line filter produced in this way, the thicknesses of the dielectric layers 111, 113, 115, 116 were respectively set to be 1.3 mm, 0.2 mm, 0.2 mm and 1.3 mm, the length $l_1$ of each of the resonators 211 through 213 was set to be 4.5 mm, the length $l_5$ of the transmission line filter was set to be 5.3 mm, the length $l_6$ and the width $W_3$ of each of the input and output electrodes 415, 416 were respectively set to be 0.2 mm and 0.2 mm, the length of each of the electrodes 311 through 313 was set to be 0.5 mm, the interval between each of the resonators 211 through 213 was set to be 0.3 mm, and others were produced by the same method as the first embodiment, the center frequency was 900 MHz, the bandwidth was 31 MHz and the insertion loss was 2.1 dB or less.

For comparison, the following example was produced by using the green sheet employed in the third embodiment. That is, the length $l_1$ of each of the resonators 211 through 213 and the length $l_5$ of the transmission line filter are made longer than that employed in the third embodiment without providing the internal ground electrode 801 on the dielectric layer 111 and without providing the internal ground electrode 802 on the dielectric layer 115, and others are constructed in the same manner as the third embodiment. It was necessary to set the length $l_1$ of each of the resonators to be 7.5 mm in order to make the center frequency the same value of 900 MHz as that of the third embodiment. Further, the length $l_5$ of the transmission line filter has also reached 8.3 mm, which was longer than 5.3 mm of the third embodiment. Furthermore, the bandwidth was 20 MHz, and narrower than that of the third embodiment. It is thus apparent from the third embodiment that the bandwidth has been greatly improved and the size of the transmission line filter was also reduced.

Fourth Embodiment

Figure 15:
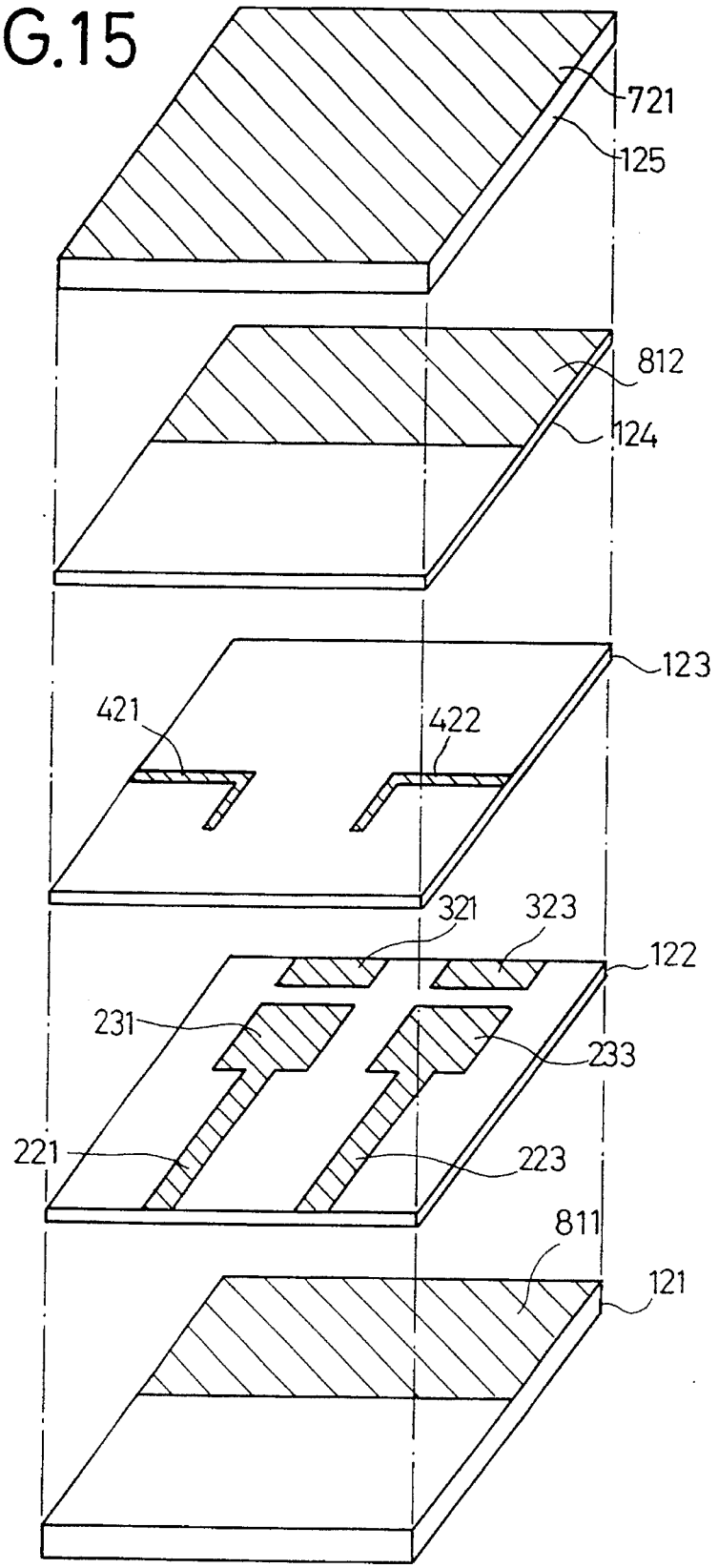
FIG. 15 is a schematic exploded perspective view showing a transmission line filter of a fourth embodiment of the present invention.
Figure 16:
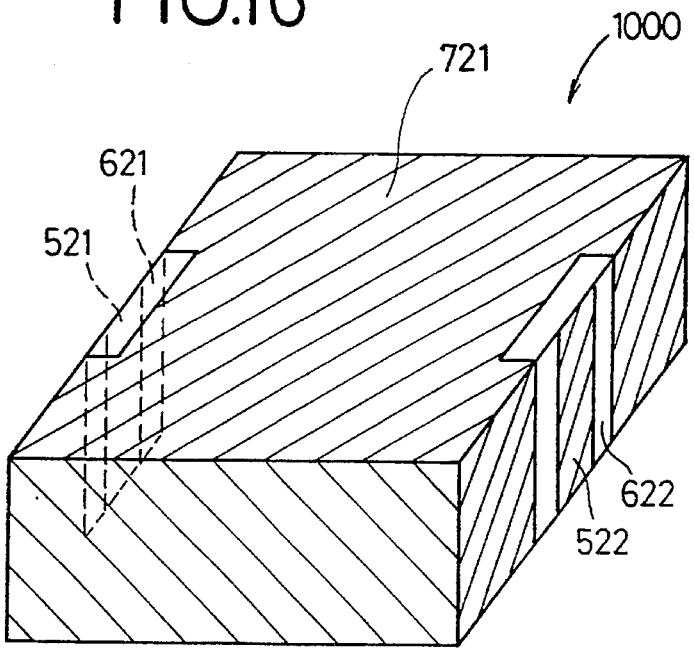
FIG. 16 is a perspective view showing the transmission line filter of the fourth embodiment of the present invention.

FIG. 15 is a schematic exploded perspective view showing the fourth embodiment of the present invention. FIG. 16 is a perspective view showing the present embodiment.

An internal ground electrode 811, which overlaps open-circuited end portions 231, 233 of resonators 221, 23 with a dielectric layer 122 interposed therebetween and which has one end connected to a ground electrode 721, is formed on a dielectric layer 121. Incidentally, the ground electrode 721 is to be formed later on the lower surface of the dielectric layer 121.

The resonators 221, 223, each of which has one end connected to the ground electrode 721 and, constituting ¼ wavelength stripline resonators, are formed on the dielectric layer 122. Conductor widths of the open-circuited end portions 231, 233 of the resonators 221, 223 are broader than those of short-circuited portions thereof. Further, electrodes 321, 323, each of which has one end connected to the ground electrode 721 and the other end spaced at predetermined intervals away from the open-circuited end portions 231, 233 of the resonators 221, 223 and opposed to the open-circuited end portions 231, 233 of the resonators 221, 223 respectively, are formed on the dielectric layer 122. A comb-line filter is constructed by making use of the distributed coupling between the resonators 221 and 223. The resonator 221 is an input-side resonator and the resonator 223 is an output-side resonator.

An input electrode 421, which overlaps the resonator 221 with a dielectric layer 123 interposed therebetween, is formed on the dielectric layer 123, and an output electrode 422, which overlaps the resonator 223 with the dielectric layer 123 interposed therebetween, is also formed on the dielectric layer 123.

An internal ground electrode 812, which overlaps the open-circuited end portions 231, 233 of the resonators 221, 223 with the dielectric layer 123 and a dielectric layer 124 interposed therebetween and which has one end connected to the ground electrode 721, is formed on the dielectric layer 124.

A dielectric layer 125, an upper surface of which ground electrode 721 is to be formed on, is stacked on the dielectric layer 124. Then, the dielectric layers 121 through 125 are combined into a single unit, followed by being fired, thereby forming a layered product 1000.

As shown in FIG. 16, the ground electrode 721 is formed on the upper and lower surfaces of the layered product 1000 and the side surfaces other than input and output terminal portions 621, 622. Further, an input terminal 521, which is insulated from the ground electrode 721 and connected to the input electrode 421, is formed in the input terminal portion 621 formed on one side surface of the layered product 1000. Furthermore, an output terminal 522, which is insulated from the ground electrode 721 and connected to the output electrode 422, is formed in the output terminal portion 622 formed on another side surface of the layered product 1000.

Figure 17:
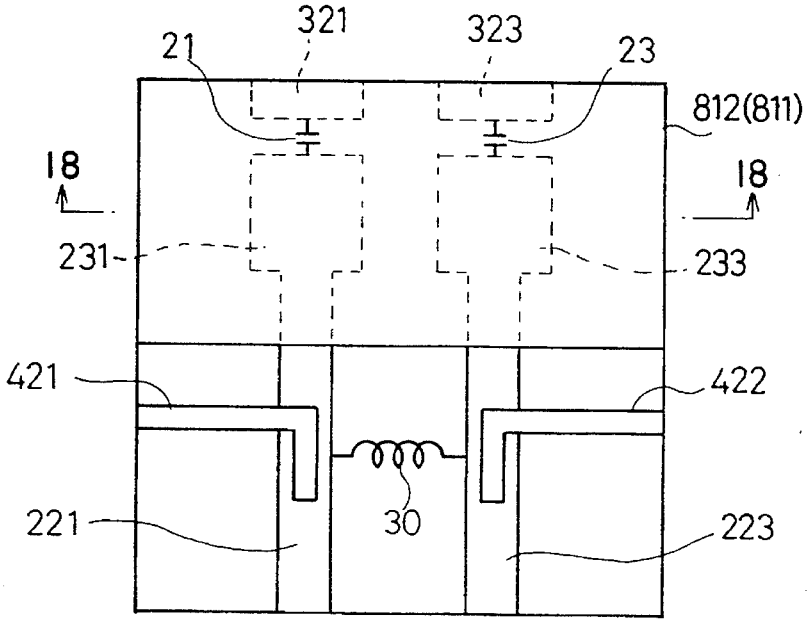
FIG. 17 is a plan view showing the structure of a principal part of the transmission line filter of the fourth embodiment of the present invention.
Figure 18:
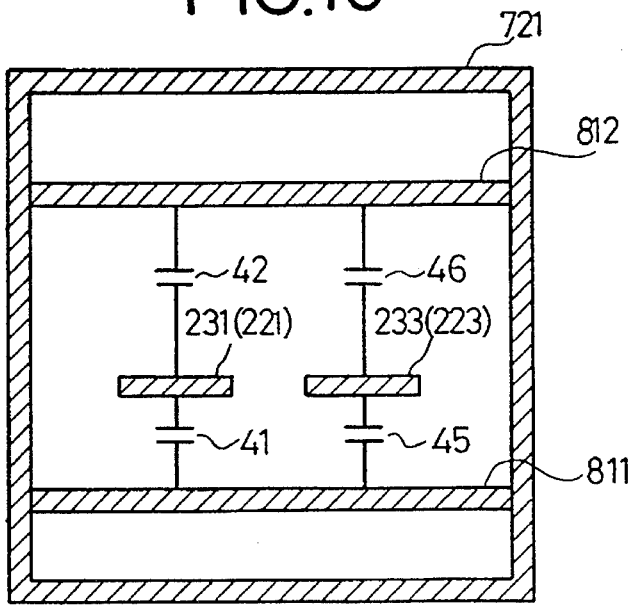
FIG. 18 is a cross-sectional view taken along the line X—X in FIG. 17.

FIG. 17 is a plan view showing a spatial structure of the resonators 221, 223, the electrodes 321, 323, the input electrode 421, the output electrode 422 and the internal ground electrodes 811, 812 employed in the present embodiment and constructed as described above, and FIG. 18 is a cross-sectional view taken along the line X—X in FIG. 17.

Capacitances 21, 23 are induced between the open-circuited end portion 231 of the resonator 221 and the electrode 321 and between the open-circuited end portion 233 and the electrode 323, respectively.

Further, capacitances 41, 42 are induced between the open-circuited end portion 231 of the resonator 221 and the internal ground electrode 811 and between the open-circuited end portion 231 and the internal ground electrode 812, respectively. Capacitances 45, 46 are also induced between the open-circuited end portion 233 of the resonator 223 and the internal ground electrode 811 and between the open-circuited end portion 233 and the internal ground electrode 812, respectively.

Due to the existence of these capacitances 21, 23, 41, 42, 45, 46 the resonators 221, 223 are coupled with each other by an inductance 30, thereby forming a comb-line type filter.

An equivalent circuit of the transmission line filter constructed as described above is shown in FIG. 19 and exhibits a bandpass characteristic. Incidentally, reference numeral 11 indicates a capacitance between the resonator 221 and the input electrode 421 and reference numeral 12 indicates a capacitance between the resonator 223 and the output electrode 422. Capacitances 221C, 223C and inductances 221L, 223L of parallel resonance circuits are capacitances and inductances obtained by expressing the resonators 221, 223 with the lumped-constant equivalent circuit.

In the present embodiment, by partly adding the internal ground electrodes 811, 812 to the open-circuited end portion side of the resonators 221, 223 in an opposed facing relationship to each other, the portions of the resonators 221, 223, which are located on the open-circuited end portion side thereof and overlap the internal ground electrodes 811, 812, become closer to the ground, thereby increasing the degree of coupling between the portions and the ground. Therefore, the degree of coupling between the portions of the resonators 221 and 223 which overlap the internal ground electrodes 811, 812, is reduced. Consequently, the coupling between the resonators 221 and 223 is mainly effected at the regions where they do not overlap with the internal ground electrodes 811, 812. This means that the coupling electrical length θ of each of the resonators 221, 223 is substantially equal to the length of each of the portions thereof which do not overlap with the internal ground electrodes 811, 812. When the electrical length θ of each of the resonators 221, 223 is thus shortened, the reactance of a distributed constant element used for coupling the resonators 221, 223 with each other is also reduced. Therefore, the resonators 221, 223 are more firmly coupled with each other, thereby making it possible to make the filter bandwidth broader.

Figure 19:
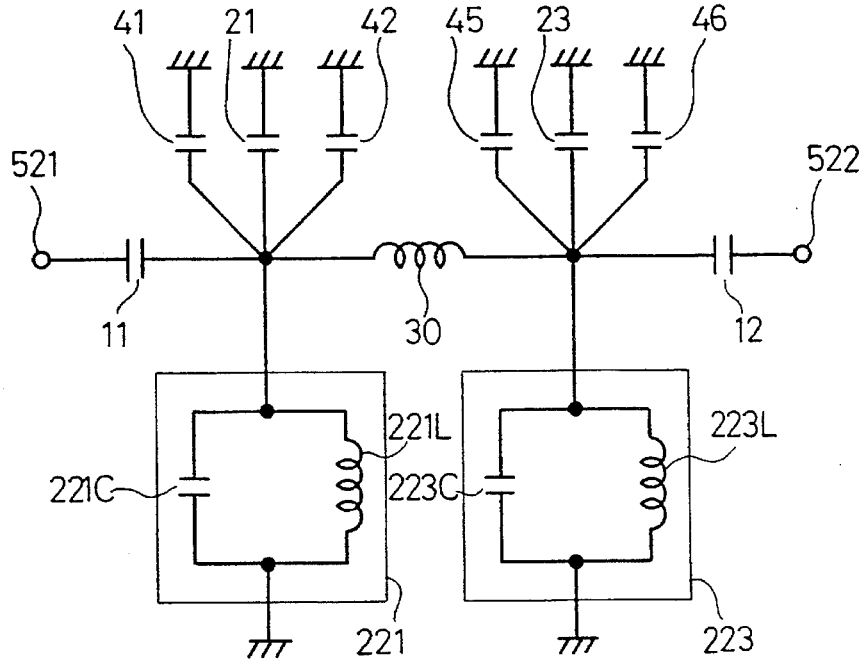
FIG. 19 is an equivalent circuit diagram of the transmission line filter of the fourth embodiment of the present invention.

Because the electrodes 321, 323 are provided, the capacitances 21, 23 are respectively induced between the respective resonators 221, 223 and the ground. Moreover, by further providing the internal ground electrodes 811, 812, the capacitances 41 and 42 and 45 and 46 are induced between the resonator 221 and the respective internal ground electrodes 811, 812 and between the resonator 223 and the respective internal ground electrodes 811, 812, respectively. As a result, these capacitances 41 and 42, 45 and 46 are also added between the respective resonators 221, 223 and the ground, respectively. Therefore, the total capacitance of the respective parallel resonance circuits shown in FIG. 19 is equal to the sum of the capacitances 221C, 223C obtained by respectively expressing the resonators 221, 223 with the lumped-constant equivalent circuit and these added capacitances 41, 42, 45 and 46. Assuming that the resonance frequencies of the resonators 221, 223 are not changed, then the inductances of the parallel resonance circuits become smaller. Therefore, the length of each of the resonators 221, 223 becomes shorter, and therefore the entire length of the transmission line filter becomes shorter as well.

In the present embodiment, the conductor widths of the open-circuited end portions 231, 233 of the resonators 221, 223 are greater than those of the short-circuited portions thereof. Therefore, the values of the capacitances 41, 42 and 45, 46 which are respectively induced between the open-circuited end portion of the resonator 221 and the respective internal ground electrodes 811, 812 and between the open-circuited end portion of the resonator 223 and the respective internal ground electrodes 811, 812, become greater as compared with the case where the conductor widths of the open-circuited end portions of the resonators are equal to those of the short-circuited end portions thereof. Further, because the capacitances 41, 42 and 45, 46 are respectively added to the capacitances 221C, 223C of the parallel resonance circuits, which are obtained by respectively expressing the resonators 221, 223 with the lumped-constant equivalent circuit, the inductances 221L, 223L of the parallel resonance circuits become much smaller. As a result, the length of each of the resonators becomes also much shorter as compared with the case where the conductor width of the open-circuited end portions of the resonators are equal to that of the short-circuited end portions. Hence, the entire length of the transmission line filter is also made shorter.

A method for manufacturing the transmission line filter according to the fourth embodiment will now be explained.

In the case of the present embodiment, the conductor patterns shown in FIG. 15 are first respectively printed on the green sheets employed in the first embodiment by using a silver paste as a conductor paste. In order to adjust the thickness of the green sheets on which the conductor patterns are printed, necessary green sheets are then stacked so as to form the structure shown in FIG. 15. The resultant product was thereafter fired at 900° C. to produce the layered product 1000.

The ground electrode 721 composed of a silver electrode, is printed on the upper and lower surfaces of the layered product 1000 and the side surfaces thereof other than the input terminal portion 621 and the output terminal portion 622, as illustrated in FIG. 16. Further, silver electrodes electrically insulated from the ground electrode 721 and respectively connected to the input electrode 421 and the output electrode 422, are printed in the input and output terminal portions 621, 622 as the input and output terminals 521, 522, respectively. The printed silver electrodes are fired at 850° C.

Fifth Embodiment

Figure 20:
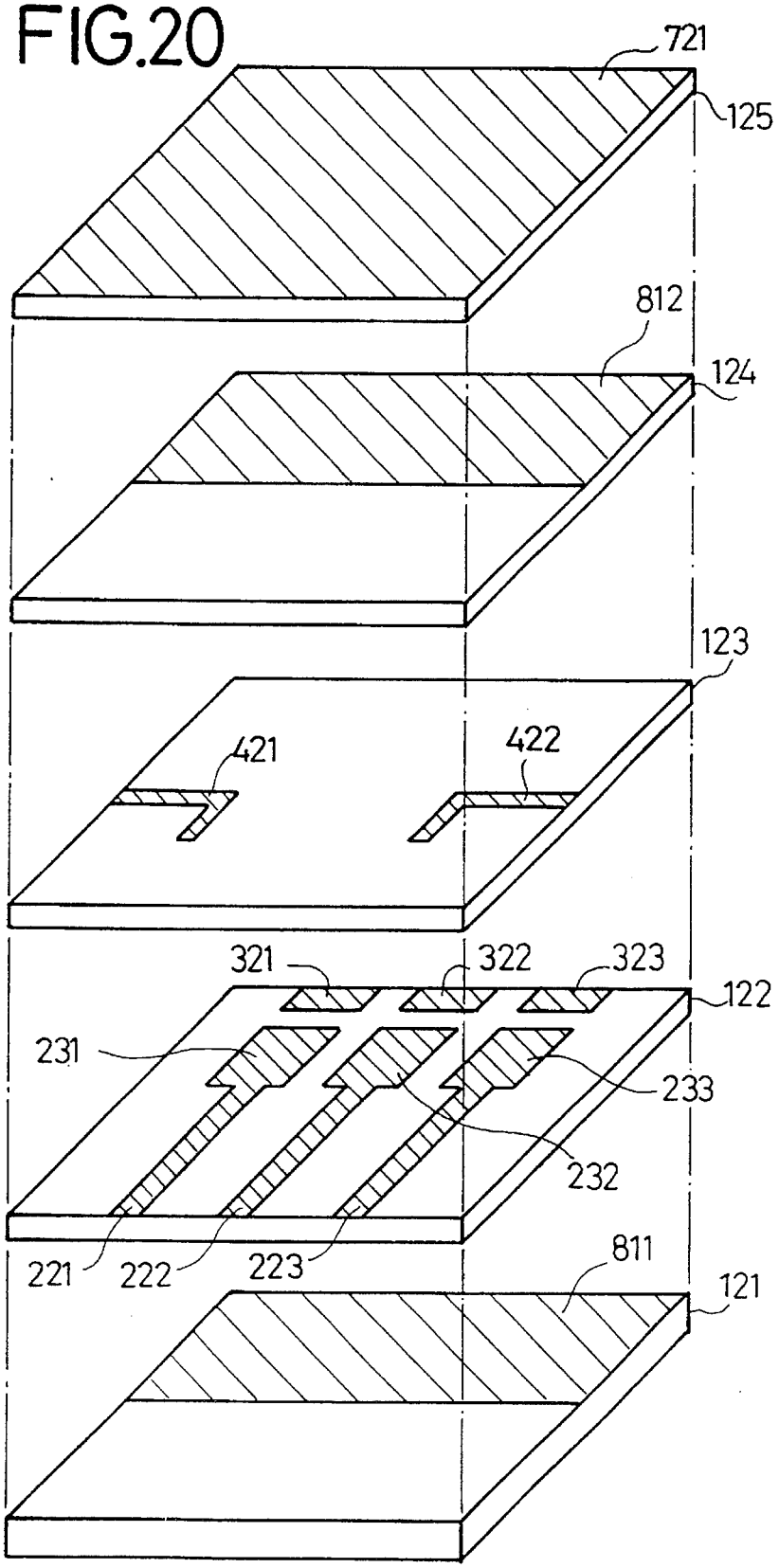
FIG. 20 is a schematic exploded perspective view showing transmission line filter of a fifth embodiment of the present invention.

A description will now be made of the fifth embodiment of the present invention. FIG. 20 is a schematic exploded perspective view showing the present embodiment.

The fourth embodiment shows, as an illustrative example, the case in which the two resonators are provided. However, the present embodiment differs from the fourth embodiment in that three resonators 221, 222, 223 are used and the resonator 222 is formed on a dielectric layer 122 disposed between the resonators 221 and 223. However, others are identical in structure to those employed in the fourth embodiment. Incidentally, the following structure is also identical to the structure of the fourth embodiment. That is, the conductor width of an open-circuited end portion 232 of the resonator 222 is set so as to be broader than that of a short-circuited end portion thereof. An electrode 322, which is spaced at a predetermined interval away from the open-circuited end portion 232 of the resonator 222, opposed to the open-circuited end portion 232 thereof and electrically connected to the ground electrode 721, is formed on the dielectric layer 122. Further, a method of manufacturing a transmission line filter is also identical to that employed in the fourth embodiment.

Sixth Embodiment

Figure 21:
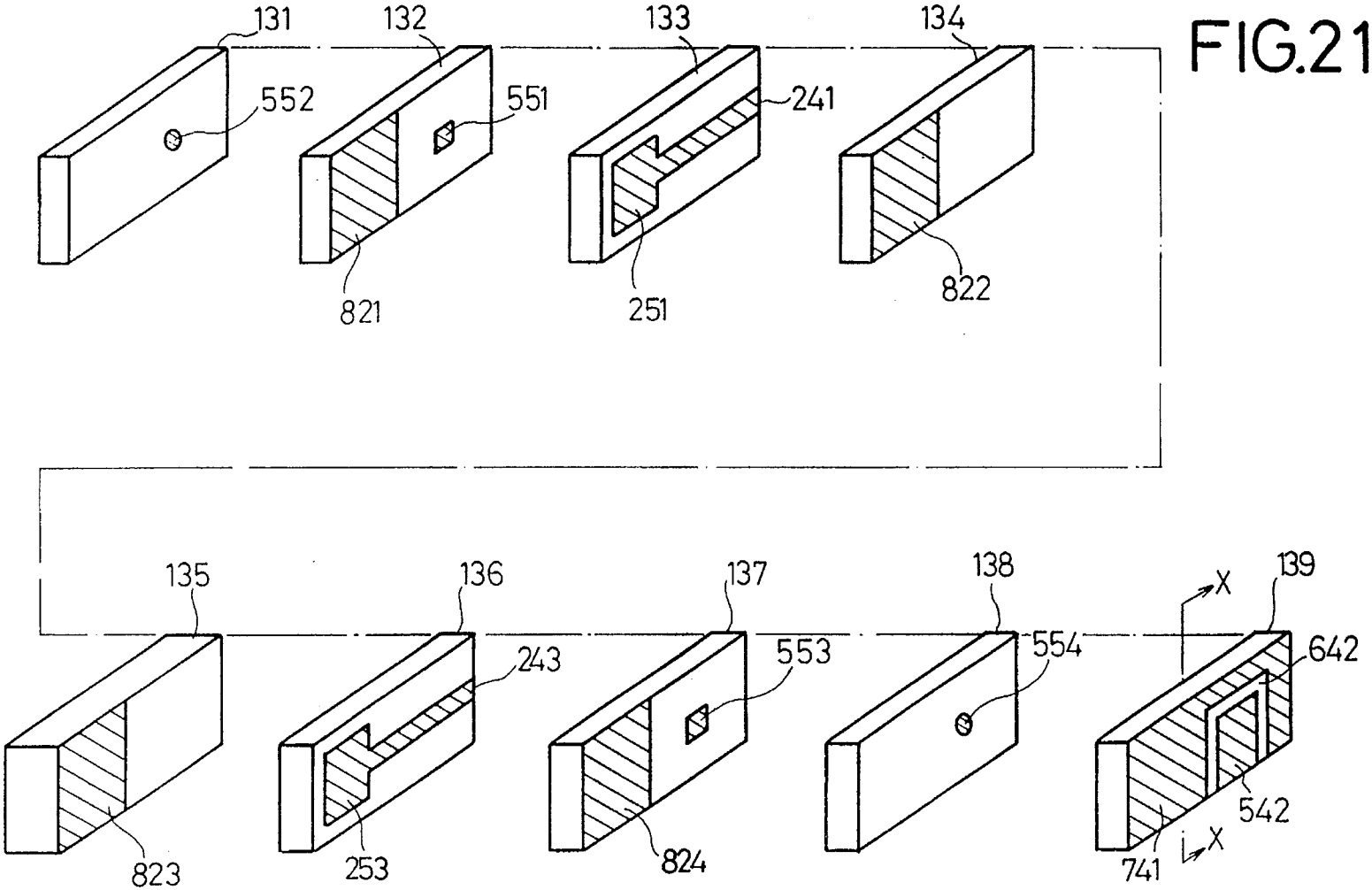
FIG. 21 is a schematic exploded perspective view showing a transmission line filter of a sixth embodiment of the present invention.
Figure 22:
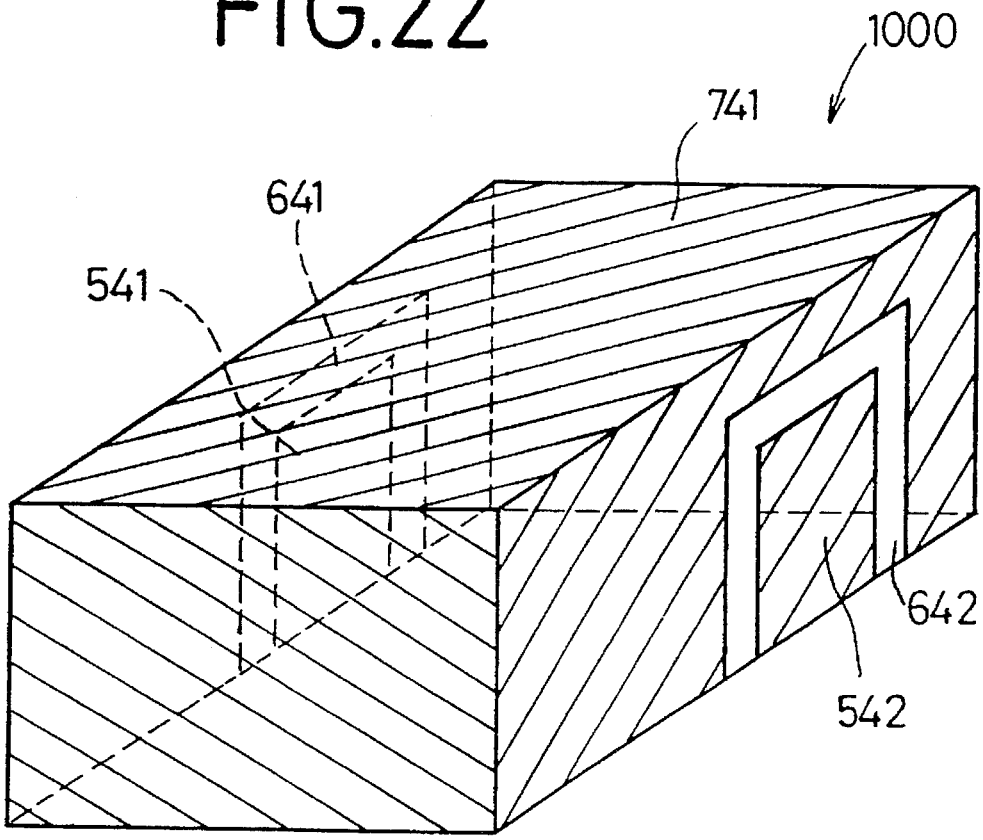
FIG. 22 is a perspective view showing the transmission line filter of the sixth embodiment of the present invention.

A description will now be made of the sixth embodiment of the present invention. FIG. 21 is a schematic exploded perspective view showing the present embodiment. FIG. 22 is a perspective view showing the present embodiment.

As shown in FIG. 21, a via hole 552 for establishing an electrical connection between an input terminal 541 to be formed on the left side surface of a dielectric layer 131 and an input capacitance pattern 551 is defined so as to extend through the dielectric layer 131. Incidentally, a ground electrode 741 is to be formed on the left side surface of the dielectric layer 131 later.

The input capacitance pattern 551 which overlaps a resonator 241 disposed on the input side with the dielectric layer 133 interposed therebetween, and an internal ground electrode 821 which overlaps an open-circuited end portion 251 of the resonator 241 with the dielectric layer 133 interposed therebetween and which has one end connected to the ground electrode 741, are both formed on the right side surface of the dielectric layer 132. Incidentally, the via hole 552, which extends through the dielectric layer 132 and is used to establish an electrical connection between the input terminal 541 and the input capacitance pattern 551, is also defined through the dielectric layer 132.

The resonator 241 whose one end is connected to the ground electrode 741 and which constitutes a ¼ wavelength stripline resonator, is formed on the right side surface of the dielectric layer 133. The conductor width of the open-circuited end portion 251 of the resonator 241 is set broader than that of a short-circuited end portion thereof. The resonator 241 serves as an input-side resonator.

An internal ground electrode 822 which overlaps the open-circuited end portion 251 of the resonator 241 with a dielectric layer 134 interposed therebetween and which has one end electrically connected to the ground electrode 741, is formed on the right side surface of the dielectric layer 134.

An internal ground electrode 823 which overlaps an open-circuited end portion 253 of a resonator 243 disposed on the output side with a dielectric layer 136 interposed therebetween and which has one end connected to the ground electrode 741, is formed on the right side surface of a dielectric layer 135.

The resonator 243 whose one end is connected to the ground electrode 741 and which constitutes a ¼ wavelength stripline resonator, is formed on the right side surface of the dielectric layer 136. The conductor width of the open-circuited end portion 253 of the resonator 243 is set so as to be broader than that of a short-circuited end portion thereof. The resonator 243 serves as an output-side resonator.

An output capacitance pattern 553 which overlaps the resonator 243 disposed on the output side with a dielectric layer 137 interposed therebetween, and an internal ground electrode 824 which overlaps the open-circuited end portion 253 of the resonator 243 with the dielectric layer 137 interposed therebetween and which has one end connected to the ground electrode 741, are both formed on the right side surface of the dielectric layer 137.

A via hole 554 which extends through a dielectric layer 138 and is used to establish an electrical connection between an output terminal 542 provided on the right side surface of a dielectric layer 139 and an output capacitance pattern 553, is defined through the dielectric layer 138.

A dielectric layer 139, the right side surface of which the ground electrode 741 and the output terminal 542 are to be formed on, is stacked on the right side surface of the dielectric layer 138. Then, the dielectric layers 131 through 139 are combined into a single unit. Thereafter, the resultant product is fired to produce a layered product 1000. Incidentally, the via hole 554 is formed through the dielectric layer 139 to establish an electrical connection between the output electrode 542 and the output capacitance pattern 553.

As shown in FIG. 22, the ground electrode 741 is formed on the upper and lower surfaces of the layered product 1000 and the side surfaces thereof other than input and output terminal portions 641, 642. Further, the input terminal 541, which is insulated from the ground electrode 741 and connected to the input capacitance pattern 551 through the via hole 552, is formed in the input terminal portion 641 formed on one side surface of the layered product 1000. Furthermore, the output terminal 542, which is insulated from the ground electrode 741 and the input terminal 541 and connected to the output capacitance pattern 553 through the via hole 554, is formed in the output terminal portion 642 formed on another side surface of the layered product 1000.

Figure 23:
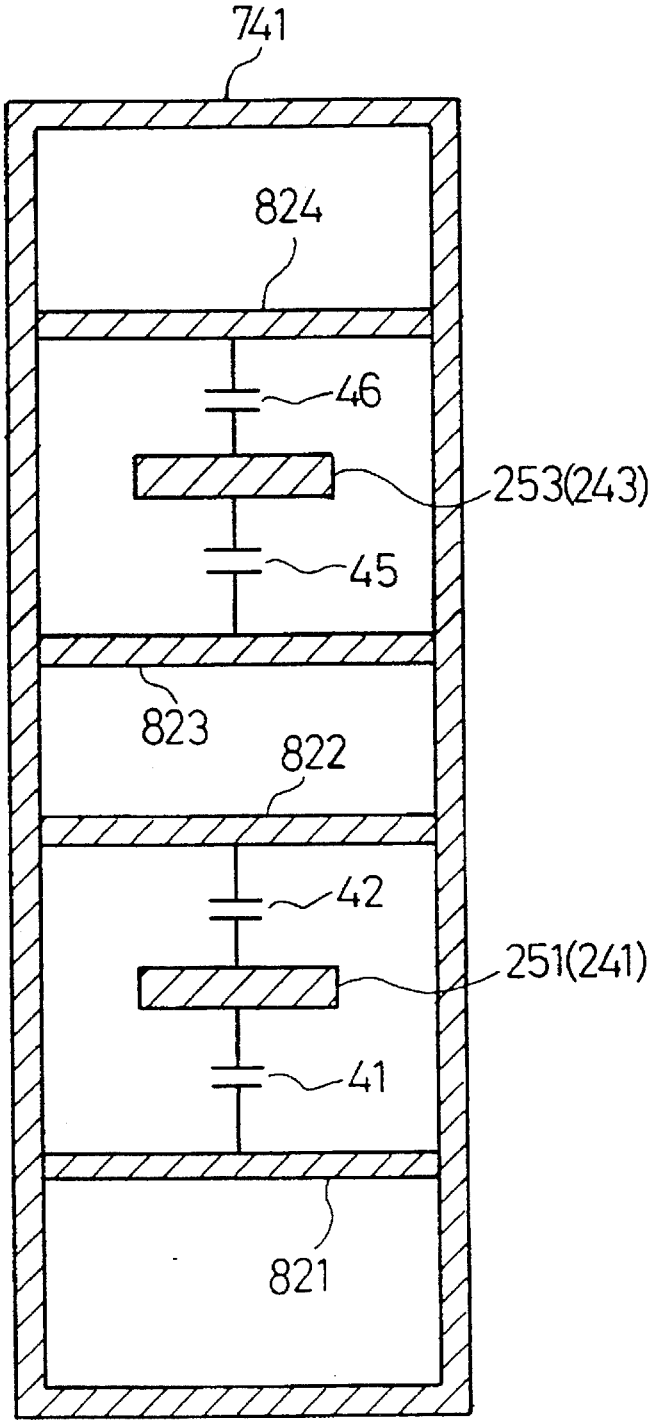
FIG. 23 is a cross-sectional view taken along the line X—X in FIG. 21.

FIG. 23 is a cross-sectional view taken along the line X—X in FIG. 21, showing a spatial structure of the resonators 241, 243 and the internal ground electrodes 821 through 824 employed in the present embodiment and constructed as described above.

Capacitances 41, 42 are induced between the open-circuited end portion 251 of the resonator 241 and the internal ground electrode 821 and between the open-circuited end portion 251 and the internal ground electrode 822, respectively. Further, capacitances 45, 46 are induced between the open-circuited end portion 253 of the resonator 243 and the internal ground electrode 823 and between the open-circuited end, portion 253 and the internal ground electrode 824, respectively.

An equivalent circuit of the transmission line filter constructed as described above is shown in FIG. 24. The resonators 241, 243 are coupled with each other by an inductance 30 to exhibit a bandpass characteristic. Incidentally, reference numeral 11 indicates a capacitance between the resonator 241 and the input capacitance pattern 551 and reference numeral 12 indicates a capacitance between the resonator 243 and the output capacitance pattern 553. Capacitances 241C, 243C and inductances 241L, 243L of parallel resonance circuits are capacitances and inductances obtained by expressing the resonators 241, 243 with the lumped-constant equivalent circuit.

Figure 24:
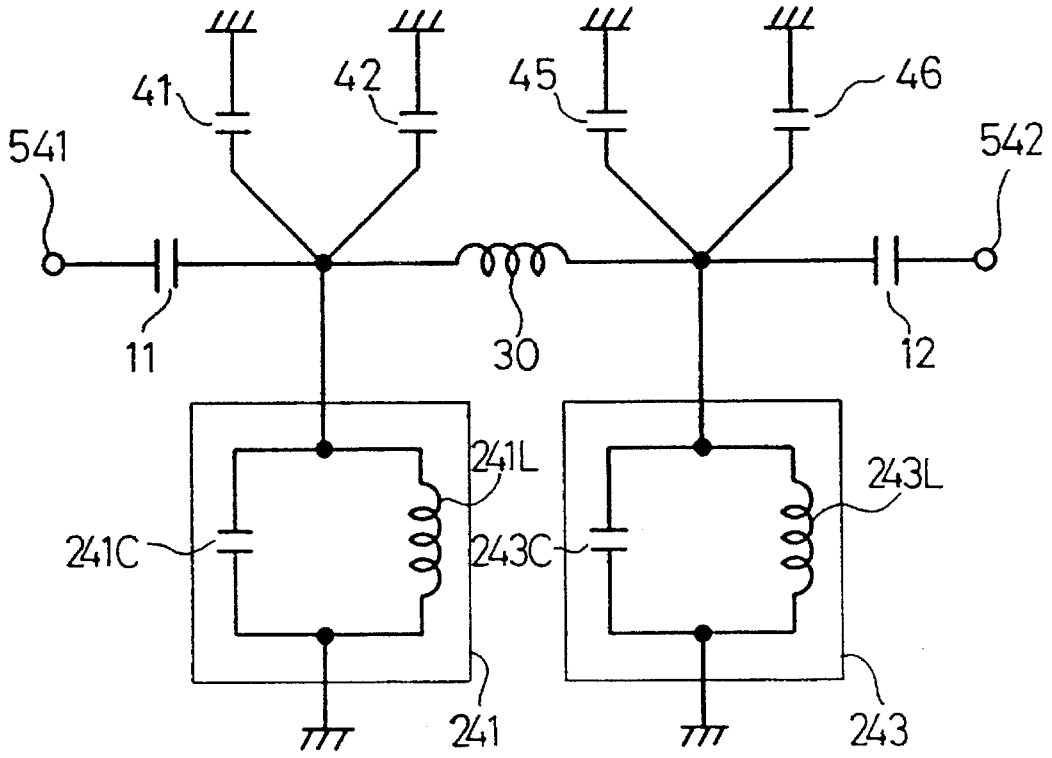
FIG. 24 is an equivalent circuit diagram of the transmission line filter of the sixth embodiment of the present invention.

Also in the present embodiment, capacitances 41, 42 and 45, 46 induced by providing the internal ground electrodes 821 through 824 are added between the resonator 241 and the ground and between the resonator 243 and the ground, respectively. Therefore, the total capacitance of the respective parallel resonance circuits shown in FIG. 24 is equal to the sum of the capacitances 241C, 243C obtained by respectively expressing the resonators 241, 243 with the lumped-constant equivalent circuit and these added capacitances 41, 42, 45, 46. Assuming that the resonance frequencies of the resonators 241, 243 are not changed, then the inductances of the parallel resonance circuits become smaller. Thus, the length of each of the resonators 241, 243 becomes shorter, and therefore the entire length of the transmission line filter becomes shorter as well. Also in the present embodiment, the conductor widths of the open-circuited end portions 251, 253 of the resonators 241, 243 are greater than those of the short-circuited end portions thereof. Therefore, the values of the capacitances 41, 42 and 45, 46 which respectively induced between the open-circuited end portion of the resonator 241 and the respective internal ground electrodes 821, 822 and between the open-circuited end portion of the resonator 243 and the respective internal ground electrodes 823, 824, become greater as compared with the case where the conductor widths of the open-circuited end portions of the resonators are equal to those of the short-circuited end portions thereof. Further, because the capacitances 41, 42 and 45, 46 are respectively added to the capacitances 241C, 243C of the parallel resonance circuits, which are obtained by respectively expressing the resonators 241, 243 with the lumped-constant equivalent circuit, the inductances 241L, 243L of the parallel resonance circuits become smaller. As a result, the length of each of the resonators becomes also shorter as compared with the case where the conductor width of the open-circuited end portions of the resonators are equal to that of the short-circuited end portions. Hence, the entire length of the transmission line filter is also made shorter.

Furthermore, in the present embodiment, by partly adding the internal ground electrodes 821 through 824 to the open-circuited end portion side of the resonators 241, 243 in an opposed facing relationship to one another, the portions of the resonators 241, 243, which are located on the open-circuited end portion side thereof and overlap the internal ground electrodes 821 through 824, are shielded from the neighboring resonators by the ground electrode, thereby causing no coupling between the portions of the resonators 241, 243 which overlap the internal ground electrodes 821 through 824. Accordingly, the coupling between the adjacent resonators 241 and 243 is effected at the regions where they do not overlap the internal ground electrodes 821 through 824. This means that the coupling electrical length θ of each of the resonators 241, 243 is substantially equal to the length of each of the portions of the resonator, which do not overlap the internal ground electrodes 821 through 824. That is, the electrical length θ becomes short. As a result, the resonators 241, 243 are firmly coupled with each other, thereby making it possible to make the filter bandwidth broader.

Further, in the present embodiment, the input capacitance pattern 551 and the output capacitance pattern 553 are formed inside the layered product 1000 based on the following reason. That is, when the dielectric layers between the respective resonators 241, 243 provided at both ends and the ground electrode 741 are thin, the Q of the filter is reduced and the insertion loss thereof increases. It is, therefore, necessary to increase the distance between each of the respective resonators 241, 243 at both ends and the ground electrode 741 to some extent. Under this condition, assuming that only the input and output terminals 541, 542 are formed on the side surfaces of the layered product 1000, the distance between each of the input and output terminals 541, 542 and each of the resonators 241, 243 at both ends increases, and therefore the value of the capacitance induced between each of the input and output terminals 541, 542 and each of the resonators 241, 243 is reduced, thereby increasing ripple. To the contrary, by forming the input capacitance pattern 551 and the output capacitance pattern 553 inside the layered product 1000 so as to reduce the distance between each of the input and output capacitance patterns and each of the resonators 241, 243 at both ends, the value of the capacitance induced therebetween can be increased, thereby making it possible to reduce the ripple.

Furthermore, the formation of the input and output terminals 541, 542 on the side surfaces of the layered product 1000 in the present embodiment is based on the following reason. That is, solder creeps up along the input and output terminals 541, 542 upon filter mounting, and therefore the filter can be more reliably mounted.

Incidentally, in the present embodiment, the input capacitance pattern 551 and the input terminal 541, and the output capacitance pattern 553 and the output terminal 542 are connected to each other through the via holes 552 and 554, respectively. It is, therefore, unnecessary to provide, on the lower surface of the layered product 1000, connecting terminals for establishing electrical connections between the input capacitance pattern 551 and the input terminal 541 and between the output capacitance pattern 553 and the output terminal 542. As a result, the problem can be solved that the contact between the connecting terminals and a mounting substrate at the time when the filter is mounted on the mounting substrate, exerts an influence on a filter characteristic, thereby making it possible to obtain a stable filter characteristic.

A method of manufacturing the transmission line filter according to the present embodiment will now be explained. In the case of the present embodiment, the conductor patterns shown in FIG. 21 are first respectively printed on the green sheets employed in the first embodiment by using a silver paste as a conductor paste. In order to adjust the thickness of the green sheets on which the conductor patterns are printed, necessary green sheets are then stacked so as to form the structure shown in FIG. 21. Thereafter, the resultant product was fired at 900° C. to produce the layered product 1000.

The ground electrode 741 composed of a silver electrode, is printed on the upper and lower surfaces of the layered product 1000 and the side surfaces thereof other than the input terminal portion 641 and the output terminal portion 642, as illustrated in FIG. 22. Further, silver electrodes insulated from the ground electrode 741 and connected to the input capacitance pattern 551 and the output capacitance pattern 553 through the via holes 552, 554, respectively, are printed in the input and output terminal portions 641, 642 as the input and output terminals 541, 542, respectively. The printed silver electrodes are fired at 850° C. to produce the transmission line filter according to the present embodiment.

Seventh Embodiment

Figure 25:
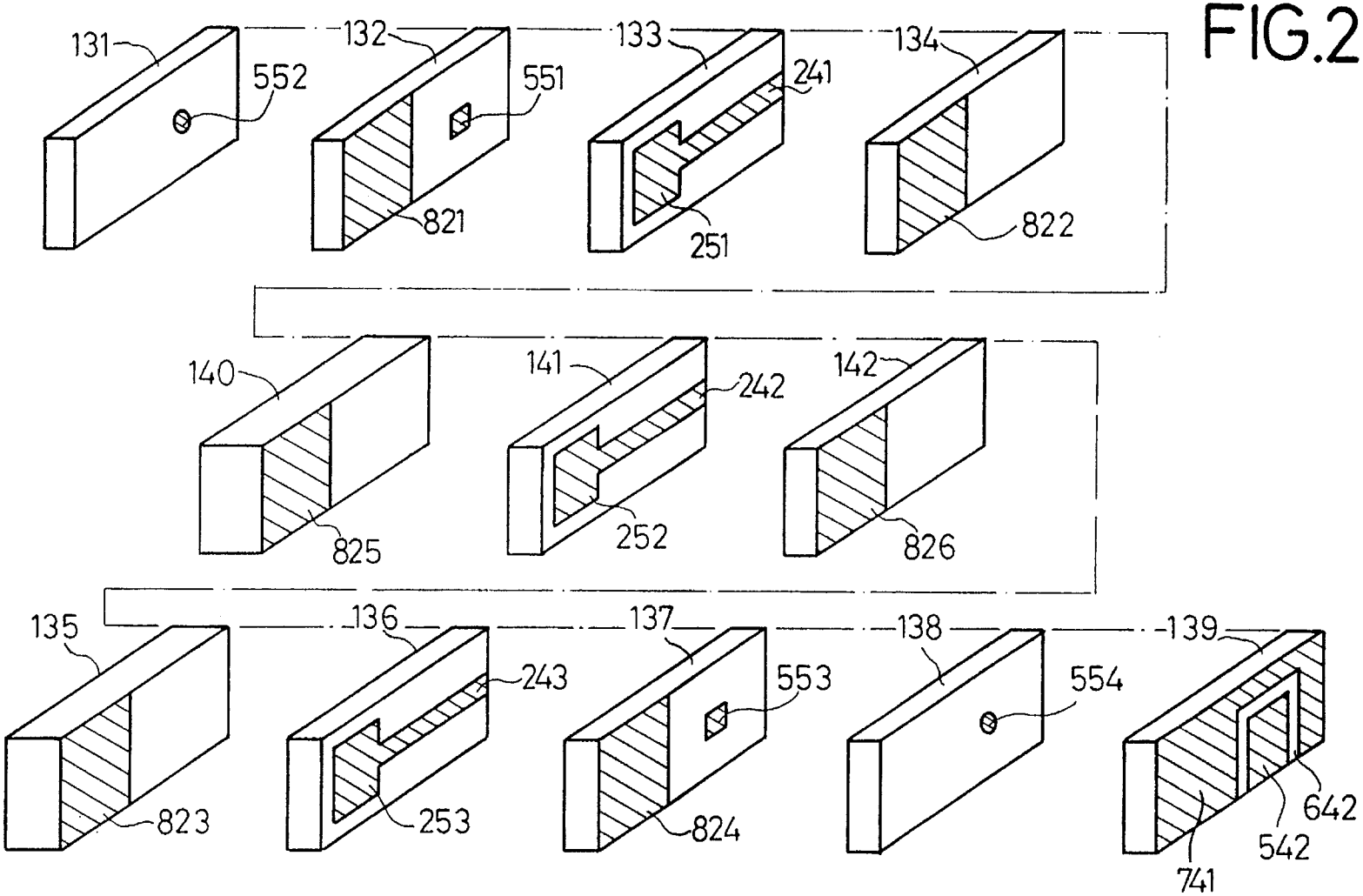
FIG. 25 is a schematic exploded perspective view showing a transmission line filter of a seventh embodiment of the present invention.

The seventh embodiment of the present invention will now be explained. FIG. 25 is a schematic exploded perspective view showing the present embodiment.

The sixth embodiment shows, as an illustrative example, the case in which the two resonators are provided. However, the present embodiment differs from the sixth embodiment in that three resonators 241, 242, 243 are used and the resonator 242 of them is formed on the right side surface of a dielectric layer 141 disposed between the resonators 241 and 243, and internal ground electrodes 825, 826 which overlap an open-circuited end portion 252 with the dielectric layers 141, 142 interposed therebetween and which have one end connected to a ground electrode 741, are respectively formed on the right side surfaces of both a dielectric layer 140 and the dielectric layer 142 disposed on both sides of the dielectric layer 141. However, others are identical in structure to those employed in the sixth embodiment. The following structure is also identical to the structure of the sixth embodiment. That is, the conductor width of the open-circuited end portion 252 of the resonator 242 is set so as to be greater than that of a short-circuited end portion thereof. Further, a method of manufacturing a transmission line filter is also identical to that employed in the sixth embodiment.

Eighth Embodiment

Figure 26:
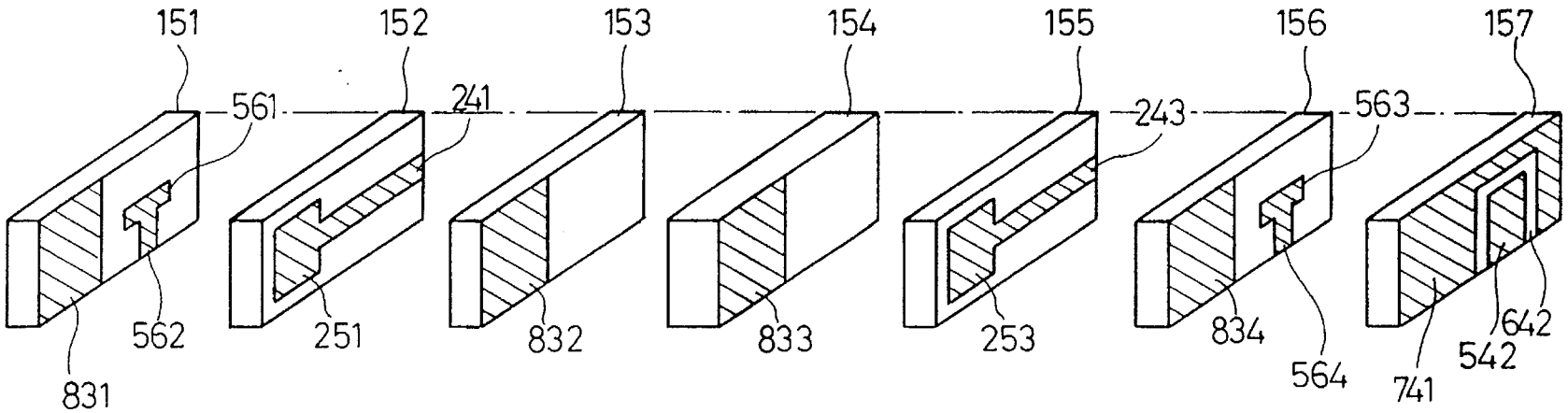
FIG. 26 is a schematic exploded perspective view showing a transmission line filter of an eighth embodiment of the present invention.
Figure 27:
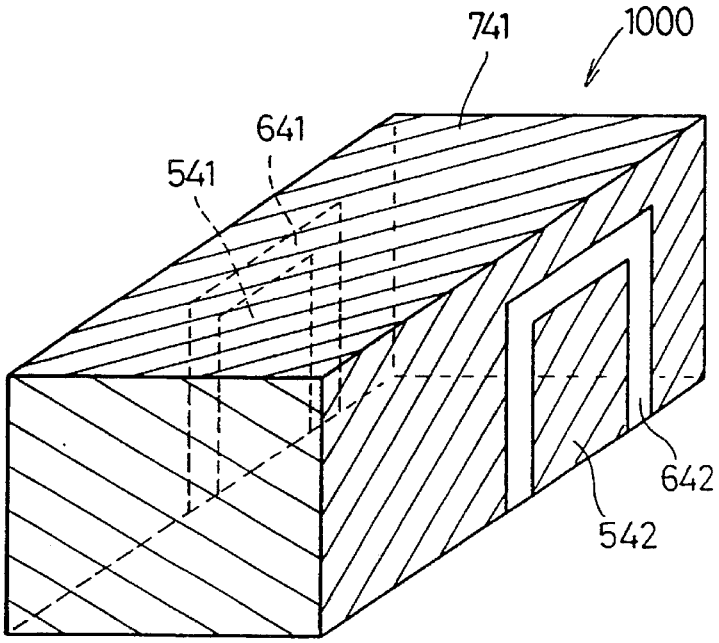
FIG. 27 is a perspective view showing the transmission line filter of the eighth embodiment of the present invention.
Figure 28:
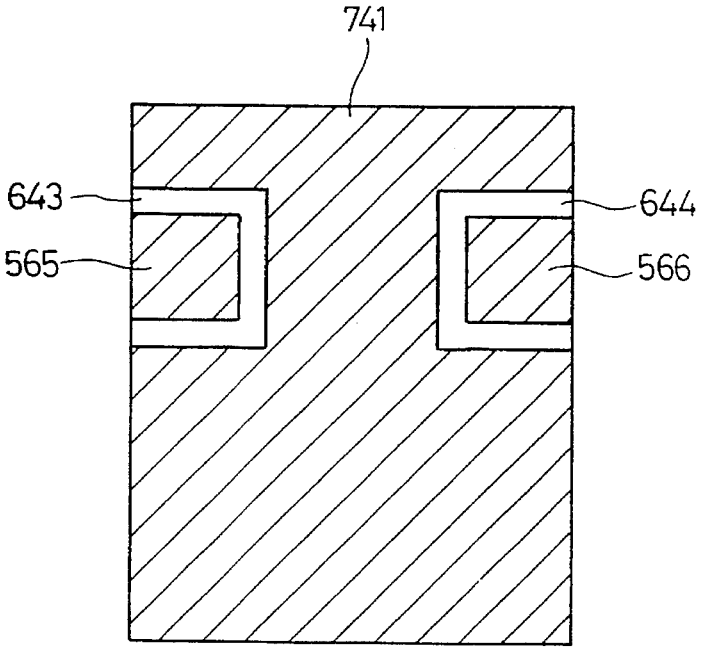
FIG. 28 is a bottom view showing the transmission line filter of the eighth embodiment of the present invention.

The eighth embodiment of the present invention will next be explained. FIG. 26 is a schematic exploded perspective view showing the present embodiment. FIG. 27 is a perspective view showing the present embodiment. FIG. 28 is a bottom view showing the present embodiment.

In the sixth embodiment, the input capacitance pattern 551 and the input terminal 541, and the output capacitance pattern 553 and the output terminal 542 are connected to each other through the via holes 552, 554, respectively. The present embodiment, however, differs from the sixth embodiment in that an input capacitance pattern 561 and an input terminal 541 are connected to each other by using both an input connecting terminal 562 provided on the right side surface of a dielectric layer 151 and an input connecting terminal 565 provided on the bottom face of a layered product 1000, and an output capacitance pattern 563 and an output terminal 542 are connected to each other by using both an output connecting terminal 564 provided on the right side surface of a dielectric layer 156 and an output connecting terminal 566 provided on the bottom face of the layered product 1000. Others are identical in structure to those employed in the sixth embodiment. The following structure is also identical to that of the sixth embodiment. That is, a conductor width of an open-circuited end portion 251 of a resonator 241 provided on the right side surface of a dielectric layer 152 is set greater than that of a short-circuited end portion thereof. Further, a conductor width of an open-circuited end portion 253 of a resonator 243 provided on the right side surface of a dielectric layer 155 is set greater than that of a short-circuited end portion thereof. Furthermore, internal ground electrodes 831 and 832 are respectively formed on the right side surfaces of both the dielectric layer 151 and a dielectric layer 153 in an opposed facing relationship to the open-circuited end portion 251 of the resonator 241, and internal ground electrodes 833 and 834 are respectively formed on the right side surfaces of both a dielectric layer 154 and the dielectric layer 156 in an opposed facing relationship to the open-circuited end portion 253 of the resonator 243. A method of manufacturing a transmission line filter is also identical to the method employed in the sixth embodiment.

In the case of the present embodiment, the length of the transmission line filter can be made shorter by providing the internal ground electrodes 831 through 834. Further, because the conductor widths of the open-circuited end portions 251, 253 of the resonators 241, 243 are greater than those of the short-circuited end portions thereof, the length of each of the resonators becomes shorter as compared with the case where the conductor widths of the open-circuited end portions of the resonators are equal to those of the short-circuited end portions thereof, thereby making it possible to make the entire length of the transmission line filter much shorter.

Also in the present embodiment, by adding the internal ground electrodes 831 through 834 to the side of the open-circuited end portions of the resonators 241, 243 in an opposed facing relationship to each other, the resonators 241, 243 are more firmly coupled to each other, thereby making it possible to make the bandwidth of a filter characteristic wider.

Further, in the present embodiment, the ripple can be reduced by forming the input capacitance pattern 561 and the output capacitance pattern 563 inside the layered product 1000.

Furthermore, in the present embodiment, solder creeps up along the input and output terminals 541, 542 upon mounting of a filter by providing the input and output terminals 541, 542 on the side surfaces of the layered product 1000, respectively, thereby making it possible to mount the filter more reliably.

Ninth Embodiment

Figure 29:
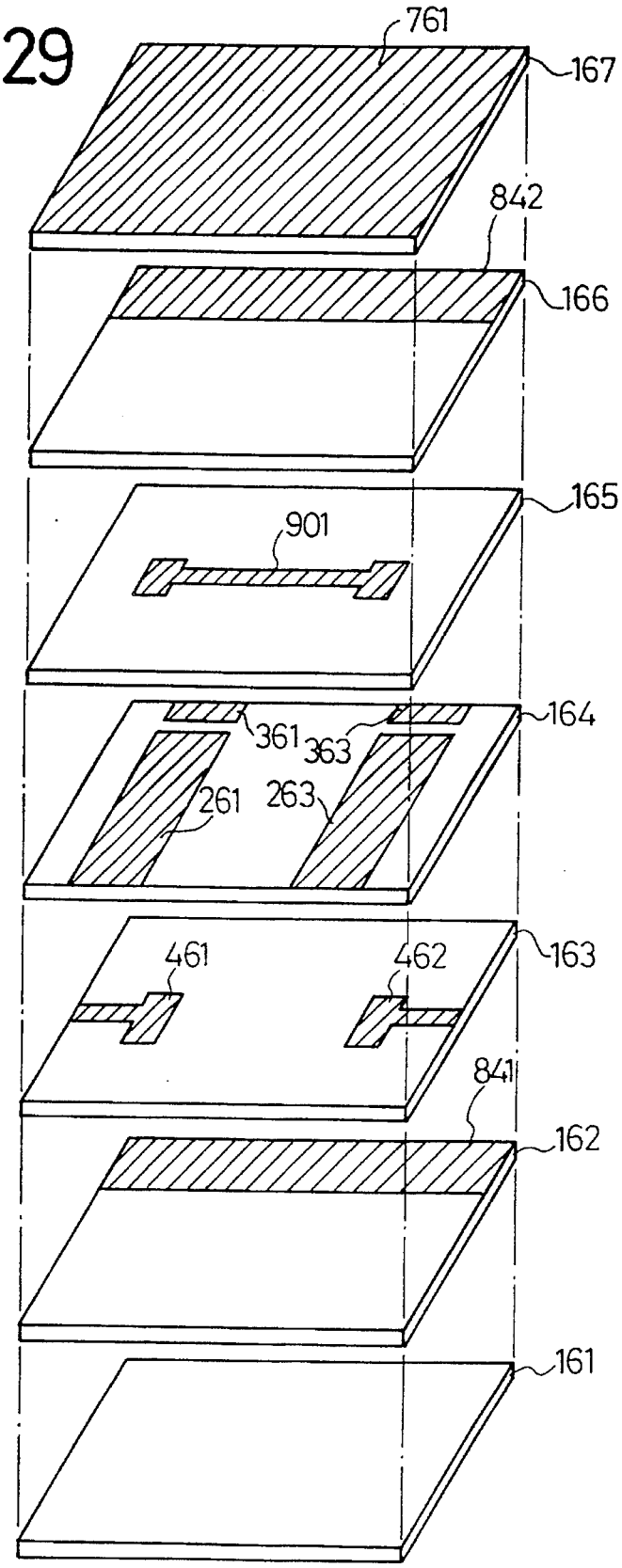
FIG. 29 is a schematic exploded perspective view showing a transmission line filter of a ninth embodiment of the present invention.
Figure 30:
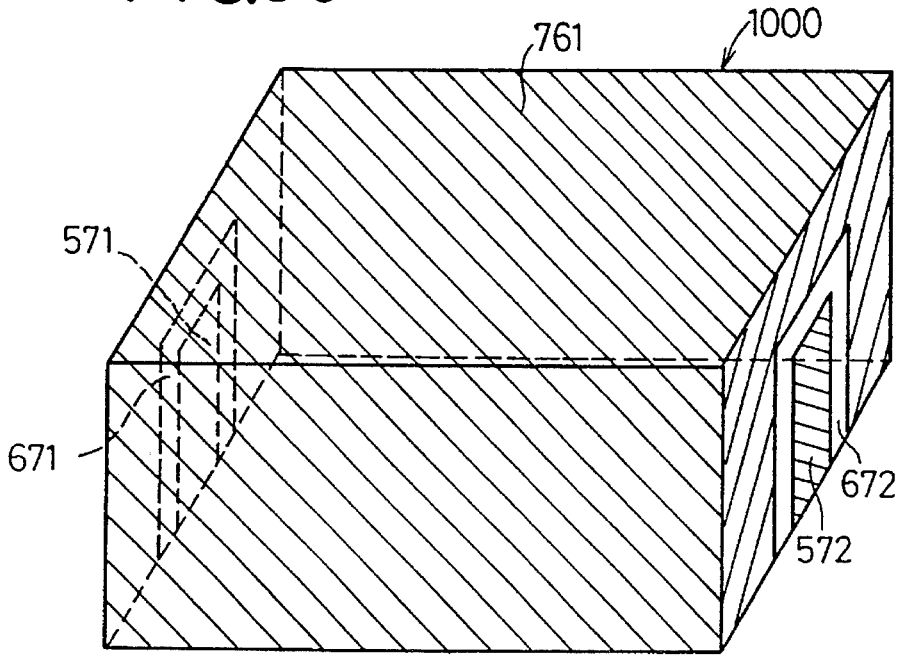
FIG. 30 is a perspective view showing the transmission line filter of the ninth embodiment of the present invention.

The ninth embodiment of the present invention will now be explained. FIG. 29 is a schematic exploded perspective view showing the ninth embodiment. FIG. 30 is a perspective view showing the present embodiment.

An internal ground electrode 841, which overlaps open-circuited end portions of resonators 261, 263 with dielectric layers 163, 164 interposed therebetween and which has one end connected to a ground electrode 761, is formed on the dielectric layer 163. Incidentally, the ground electrode 761 is to be formed later on the lower surface of a dielectric layer 161.

Formed on the dielectric layer 163 are an input electrode 461 which overlaps the resonator 261 on the input side with the dielectric layer 164 interposed therebetween, and an output electrode 462 which overlaps the resonator 263 on the output side with the dielectric layer 164 interposed therebetween.

The resonators 261, 263, each of which having one end connected to the ground electrode 761, constituting ¼ wavelength stripline resonators, are formed on the dielectric layer 164. Further, electrodes 361, 363, each of which having one end connected to the ground electrode 761 and and the other end spaced at predetermined intervals away from the open-circuited end portions of the resonators 261, 263 and opposed to the open-circuited end portions of the resonators 261, 263, are formed on the dielectric layer 164. A comb-line filter is constructed by making use of the distributed coupling between the resonators 261 and 263.

A coupling adjusting electrode 901, which overlaps the resonators 261, 263 with a dielectric layer 165 interposed therebetween, is formed on the dielectric layer 165. An internal ground electrode 842, which overlaps the open-circuited end portions of the resonators 261, 263 with the dielectric layer 165 and a dielectric layer 166 interposed therebetween and which has one end connected to the ground electrode 761, is formed on the dielectric layer 166.

A dielectric layer 167, an upper surface of which the ground electrode 761 is to be formed on, is stacked on the dielectric layer 166. Then, the dielectric layers 161 through 167 are combined into a single unit. Thereafter, the resultant product is fired to produce a layered product 1000.

As shown in FIG. 30, the ground electrode 761 is formed on the upper and lower surfaces of the layered product 1000 and the side surfaces other than input and output terminal portions 671, 672. Further, an input terminal 571, which is insulated from the ground electrode 761 and connected to the input electrode 461, is formed in the input terminal portion 671 formed on one side surface of the layered product 1000. An output terminal 572, which is insulated from the ground electrode 761 and connected to the output electrode 462, is formed in the output terminal portion 672 formed on another side surface of the layered product 1000.

Figure 31:
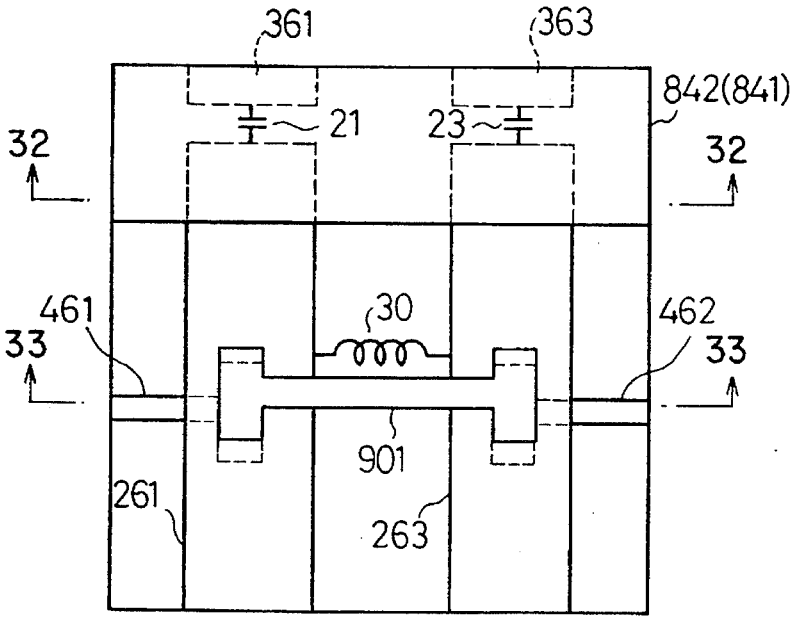
FIG. 31 is a plan view showing the structure of a principal part of the transmission line filter of the ninth embodiment of the present invention.
Figure 32:
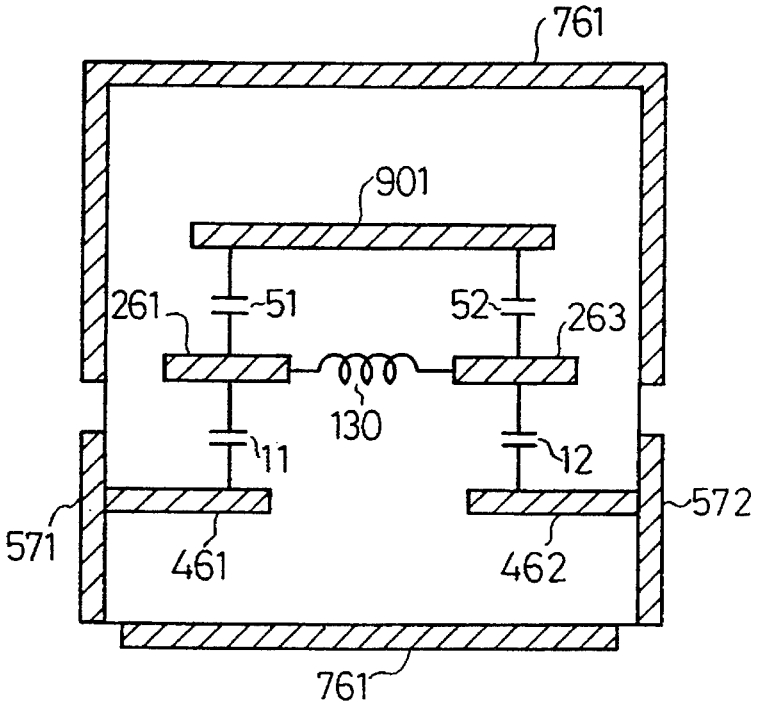
FIG. 32 is a cross-sectional view taken along the line X—X in FIG. 31.
Figure 33:
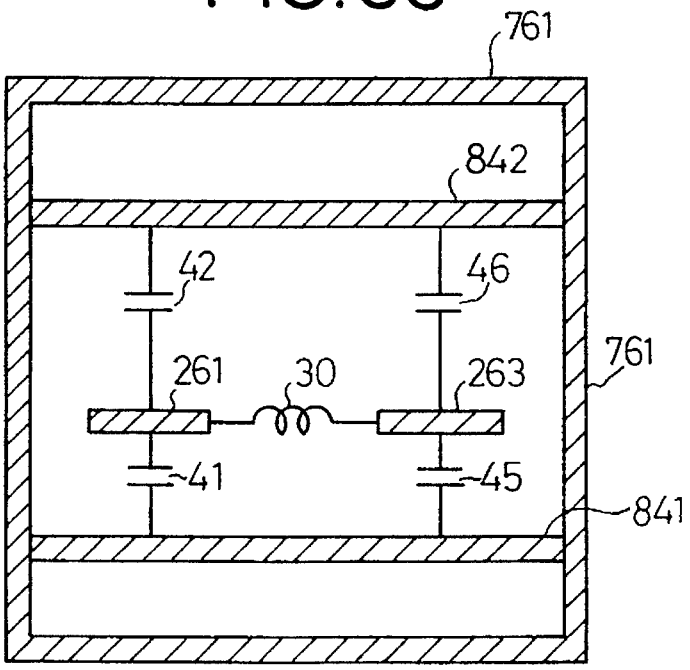
FIG. 33 is a cross-sectional view taken along the line Y—Y in FIG. 31.

FIG. 31 is a plan view showing a spatial structure of the resonators 261, 263, the electrodes 361, 363, the input electrode 461, the output electrode 463, the internal ground electrodes 841, 842 and the coupling adjusting electrode 901 employed in the present embodiment and constructed as described above. FIGS. 32 and 33 are a cross-sectional view taken along the line X—X in FIG. 31, and a cross-sectional view taken along the line Y—Y in FIG. 31, respectively.

Capacitances 21, 23 are induced between the open-circuited end portion of the resonator 261 and the electrode 361 and between the open-circuited end portion of the resonator 263 and the electrode 363 respectively. Further, capacitances 41, 42 are induced between the open-circuited end portion of the resonator 261 and the internal ground electrode 841 and between the open-circuited end portion thereof and the internal ground electrode 842, respectively. Furthermore, capacitances 45, 46 are induced between the open-circuited end portion of the resonator 263 and the internal ground electrode 841 and between the open-circuited end portion thereof and the internal ground electrode 842, respectively. Due to the existence of these capacitances 21, 23, 41, 42, 45, 46, the resonators 261, 263 are coupled with each other by an inductance 30, thereby forming a comb-line type filter.

A capacitance 11 is induced between the input electrode 461 and the resonator 261, and a capacitance 12 is induced between the output electrode 462 and the resonator 263.

Further, a capacitance 51 is induced between the resonator 261 and the coupling adjusting electrode 901, and a capacitance 52 is induced between the resonator 263 and the coupling adjusting electrode 901.

Figure 34:
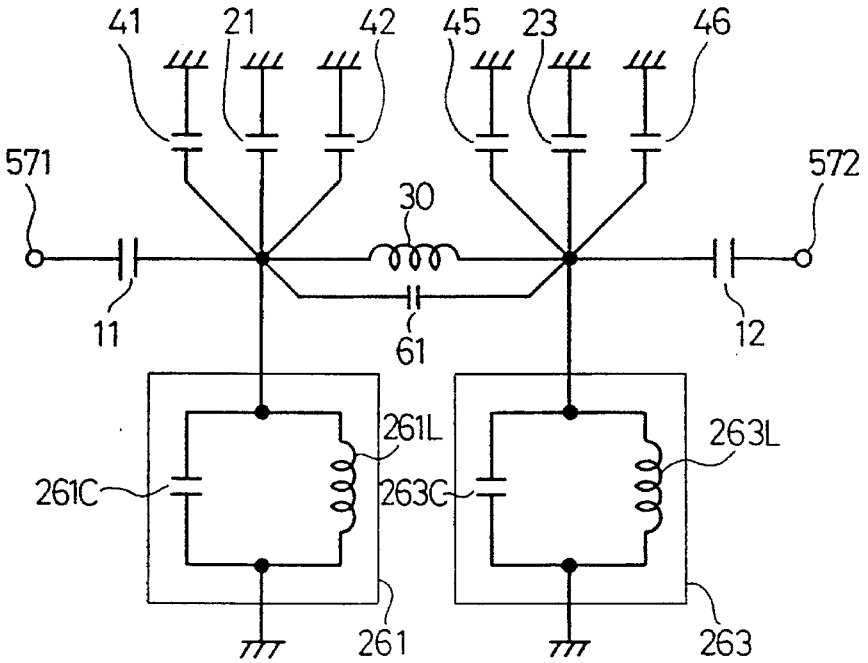
FIG. 34 is an equivalent circuit diagram of the transmission line filter of the ninth embodiment of the present invention.

An equivalent circuit of the transmission line filter constructed as described above is shown in FIG. 34 and exhibits a bandpass characteristic. Incidentally, reference numeral 61 indicates the combined capacitance equal to the sum of the capacitance 51 induced between the resonator 261 and the coupling adjusting electrode 901 and the capacitance 52 induced between the resonator 263 and the coupling adjusting electrode 901. Further, capacitances 261C, 263C and inductances 261L, 263L of parallel resonance circuits are capacitances and inductances obtained by expressing the resonators 261, 263 with the lumped-constant equivalent circuit.

In the present embodiment, because the capacitance 61 is connected in parallel to the inductance 30 induced between the resonators 261 and 263, the inductive coupling, which is induced between the resonators 261 and 263, and is represented by the inductance 30, can be controlled by the capacitance 61. Therefore, the degree of inductive coupling between the resonators 261 and 263 can be adjusted by adjusting the value of the capacitance 61, thereby making it possible to obtain a filter having a desired bandwidth. Furthermore, because the capacitance 61 is the combined capacitance equal to the sum of the capacitance 51 induced between the resonator 261 and the coupling adjusting electrode 901 and the capacitance 52 induced between the resonator 263 and the coupling adjusting electrode 901, the adjustment of the value of the capacitance 61 can be easily effected by adjusting the area at which the resonator 261 and the coupling adjusting electrode 901 overlap each other and the distance defined therebetween, and the area at which the resonator 263 and the coupling adjusting electrode 901 overlap each other and the distance defined therebetween.

In the present embodiment, because the internal ground electrodes 841, 842 are disposed in the opposed facing relationship to the open-circuited end portions of the resonators 261, 263, the capacitances 41, 42 respectively induced between the open-circuited end portion of the resonator 261 and the respective internal ground electrodes 841, 842, are added to the capacitance 261C of the parallel resonance circuit, which is obtained by expressing the resonator 261 with the lumped-constant equivalent circuit. Further, the capacitances 45, 46 respectively induced between the open-circuited end portion of the resonator 263 and the respective internal ground electrodes 841, 842, are added to the capacitance 263C of the parallel resonance circuit, which is obtained by expressing the resonator 263 with the lumped-constant equivalent circuit. Thus, assuming that the resonance frequencies of the two parallel resonance circuits are not changed, then the inductances 261L, 263L of the parallel resonance circuits become small. As a result, the length of each of the resonators 261, 263 becomes shorter, and therefore the entire length of the transmission line filter can also be reduced.

In this case, a problem arises that when the areas at which the internal ground electrodes 841, 842 overlap the resonators 261, 263 respectively, are increased to reduce the transmission line filter in size, the resonators 261, 263 become more strongly inductively-coupled to each other, thereby making the bandwidth of the filter characteristic too broad. In the present embodiment, however, because the coupling adjusting electrode 901 is disposed in the opposed facing relationship to each of the resonators 261, 263, the inductive coupling between the resonators 261 and 263 can be controlled by means of the capacitances 51, 52 respectively induced between the coupling adjusting electrode 901 and the respective resonators 261, 263, thereby making it possible to obtain a filter having a desired bandwidth. Thus, a transmission line filter which does not have an excessive increase in the bandwidth of the filter characteristic even if the transmission line filter is reduced in size, can be obtained by providing the internal ground electrodes 841, 842 disposed in the opposed facing relationship to the open-circuited end portions of the resonators 261, 263 respectively and by providing the coupling adjusting electrode 901 disposed in the opposed facing relationship to the resonators 261, 263.

Figure 35:
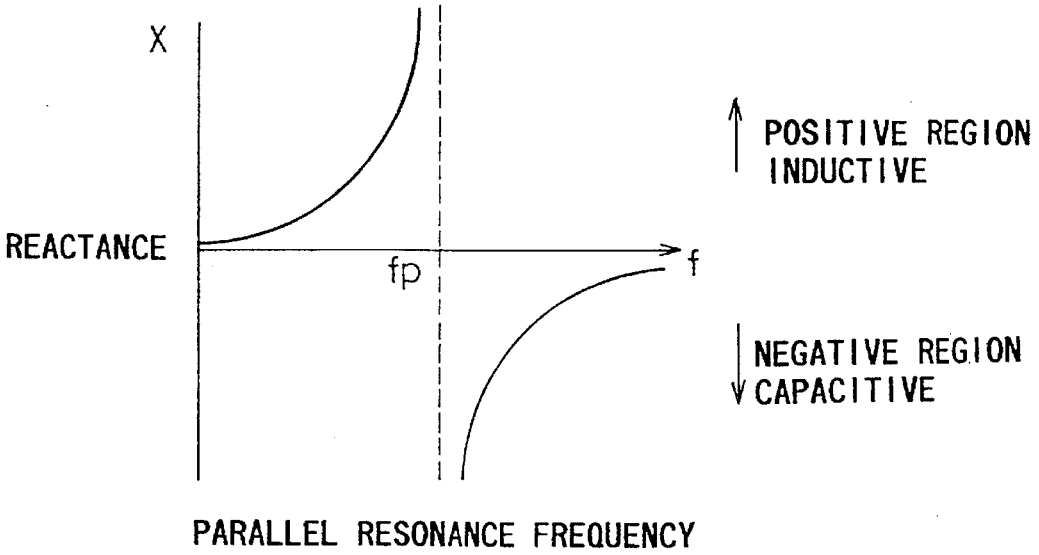
FIG. 35 is a view for explaining the impedance of a parallel resonance circuit composed of the capacitance and inductance.
Figure 36A:
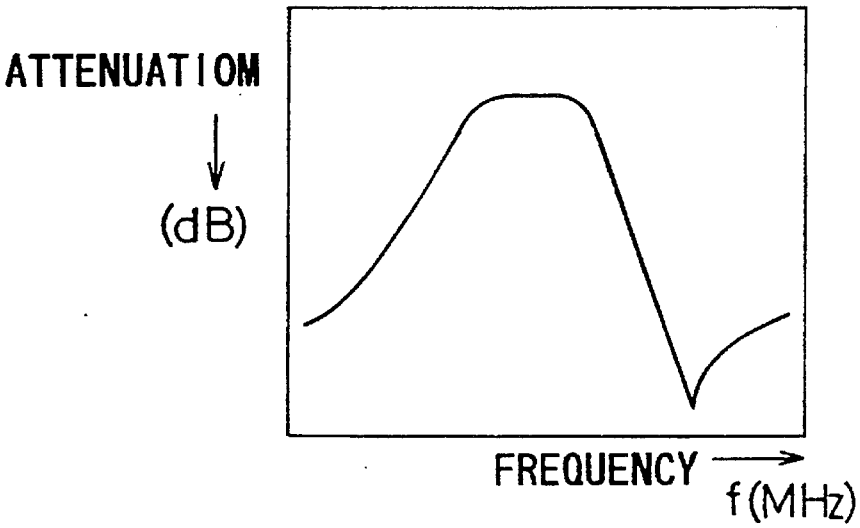
FIG. 36(*a–b*) is a view for explaining frequency characteristics of the transmission line filter of the ninth embodiment of the present invention.
Figure 36B:
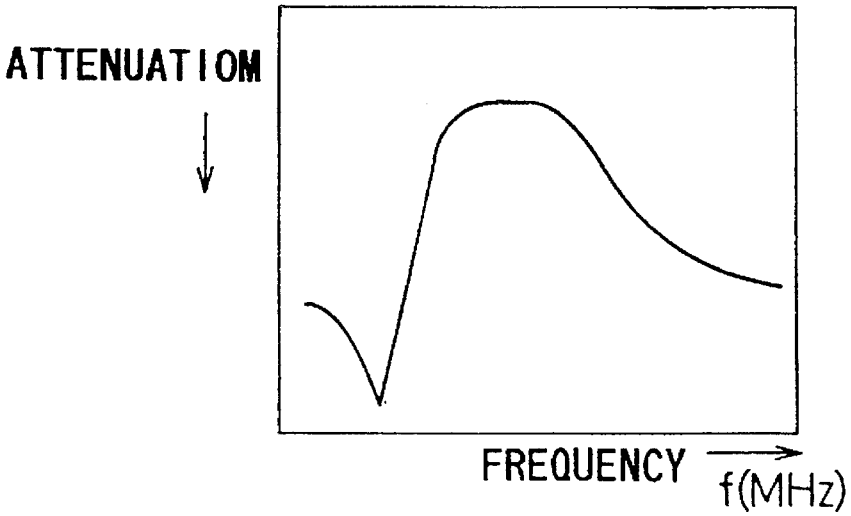

In the present embodiment, as described above, by providing the coupling adjusting electrode 901 in the opposed facing relationship to the resonators 261, 263, the combined capacitance 61 of the capacitances 51, 52, which are induced between the respective resonators 261, 263 and the coupling adjusting electrode 901, is connected in parallel to the inductance 30 induced between the resonators 261 and 263, thereby inserting a parallel resonance circuit composed of the capacitance 61 and the inductance 30 between the resonators 261 and 263. Because the impedance of the parallel resonance circuit composed of the capacitance 61 and the inductance 30 varies from an inductive to a capacitive at points before and after the parallel resonance point up as shown in FIG. 35, the coupling between the resonators 261 and 263 can be made either inductive or capacitive by adjusting the values of the capacitances 51, 52 respectively induced between the respective resonators 261, 263 and the coupling adjusting electrode 901. Let's now consider the case where the coupling between the resonators 261 and 263 is made inductive, then a filter having the attenuation peak on the high-frequency side as shown in FIG. 36A can be obtained because the parallel resonance point exists on the high-frequency side of the passband. When, on the other hand, the coupling between the resonators 261 and 263 is made capacitive, then a filter having the attenuation peak on the low-frequency side as illustrated in FIG. 36B can be obtained because the parallel resonance point exists on the low-frequency side of the passband. Thus, the attenuation characteristics of the filters can be improved in either case.

A method of forming the transmission line filter according to the ninth embodiment will next be explained.

In the case of the present embodiment, the conductor patterns shown in FIG. 29 are respectively printed on the green sheets employed in the first embodiment by using a silver paste as a conductor paste. In order to adjust the thickness of the green sheets on which the conductor patterns are printed, necessary green sheets are thereafter stacked so as to form the structure shown in FIG. 29. The resultant product is fired at 900° C. to produce a layered product 1000.

The ground electrode 761 composed of a silver electrode, is printed on the upper and lower surfaces of the layered product 1000 and the side surfaces thereof other than the input terminal portion 671 and the output terminal portion 672 as shown in FIG. 30. Further, silver electrodes electrically insulated from the ground electrode 761 and respectively connected to the input electrode 461 and the output electrode 462, are printed in the input and output terminal portions 671, 672 as the input and output terminals 571, 572, respectively. The printed silver electrodes are fired at 850° C.

Tenth Embodiment

Figure 37:
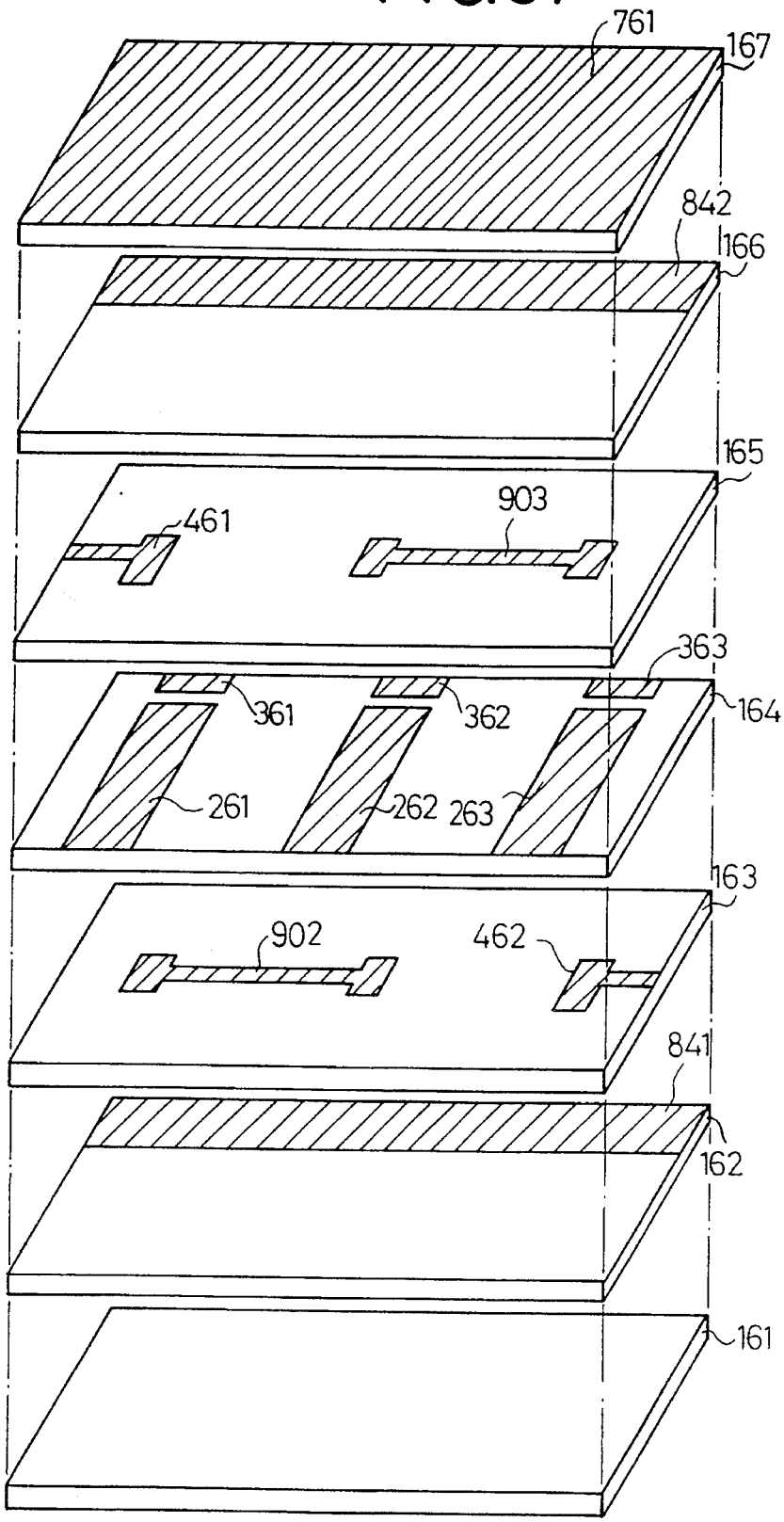
FIG. 37 is a schematic exploded perspective view showing a transmission line filter of a tenth embodiment of the present invention.

An explanation will now be made of the tenth embodiment of the present invention. FIG. 37 is a schematic exploded perspective view showing the present embodiment.

The ninth embodiment shows, as an illustrative example, the case where the two resonators are used. In the present embodiment, however, three resonators 261, 262, 263 are used. The resonator 262 is formed on a dielectric layer 164 between the resonators 261 and 263. An internal ground electrode 841, which overlaps open-circuited end portions of the resonators 261, 262, 263 with a dielectric layer 163 and the dielectric layer 164 interposed therebetween and which has one end connected to a ground electrode 761, is formed on a dielectric layer 162. Incidentally, the ground electrode 761 is to be formed later on the lower surface of a dielectric layer 161.

An output electrode 462 which overlaps the resonator 263 on the output side with the dielectric layer 164 interposed therebetween, and a coupling adjusting electrode 902 which overlaps the resonators 261, 262 with the dielectric layer 164 interposed therebetween, are both formed on the dielectric layer 163.

The resonators 261, 263, 263, each of which has one end connected to the ground electrode 761 and, constituting ¼ wavelength stripline resonators, are formed on the dielectric layer 164. Further, electrodes 361, 362, 363, each of which has one end connected to the ground electrode 761 and the other end spaced at predetermined intervals away from the open-circuited end portions of the resonators 261, 262, 263 and opposed to the open-circuited end portions of the resonators 261, 262, 263 respectively, are formed on the dielectric layer 164. A comb-line filter is constructed by using the distributed coupling between the respective adjacent resonators 261, 262, 263.

An input electrode 461 which overlaps the resonator 261 with a dielectric layer 165 interposed therebetween, and a coupling adjusting electrode 903 which overlaps the resonators 262, 263 with the dielectric layer 165 interposed therebetween, are both formed on the dielectric layer 165.

An internal ground electrode 842, which overlaps the open-circuited end portions of the resonators 261, 262, 263 with the dielectric layers 165, 166 interposed therebetween and which has one end connected to the ground electrode 761, is formed on a dielectric layer 166.

A dielectric layer 167, an upper surface of which the ground electrode 761 is to be formed on, is stacked on the dielectric layer 166. Then, the dielectric layers 161 through 167 are combined into a single unit. Thereafter, the resultant product is fired to obtain a layered product 1000.

As shown in FIG. 30, the ground electrode 761 is formed on the upper and lower surfaces of the layered product 1000 and the side surfaces other than input and output terminal portions 671, 672. Further, an input terminal 571, which is insulated from the ground electrode 761 and connected to the input electrode 461, is formed in the input terminal portion 671 formed on one side surface of the layered product 1000. An output terminal 572, which is insulated from the ground electrode 761 and connected to the output electrode 462, is formed in the output terminal portion 672 formed on another side surface of the layered product 1000.

Figure 38:
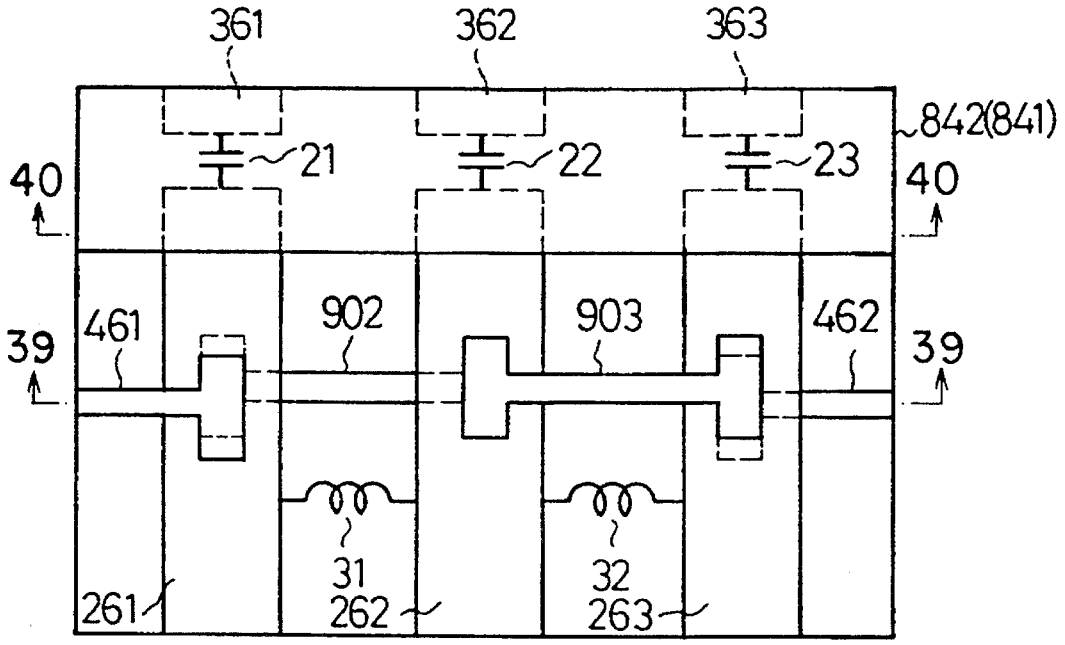
FIG. 38 is a plan view showing the structure of a principal part of the transmission line filter of the tenth embodiment of the present invention.
Figure 39:
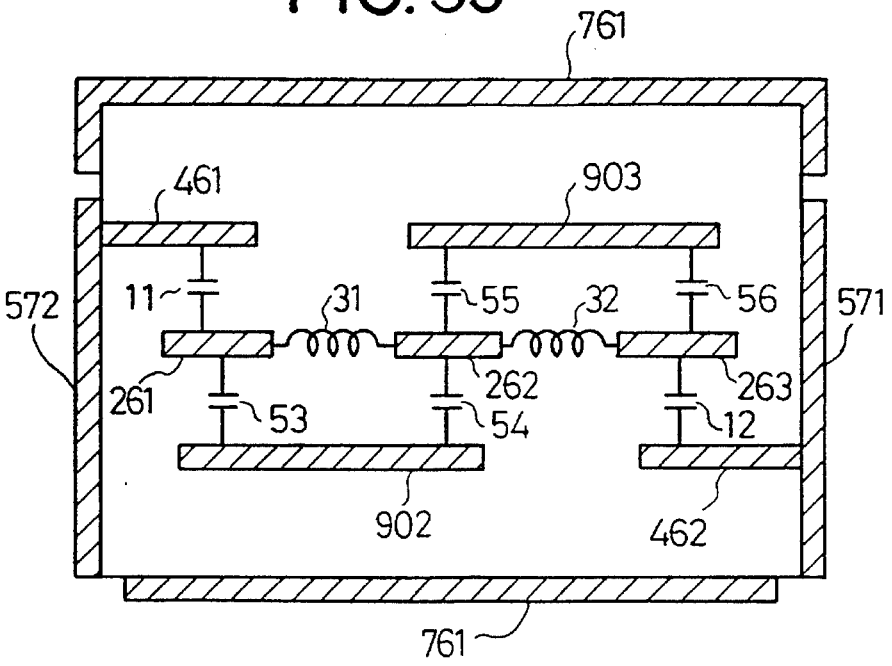
FIG. 39 is a cross-sectional view taken along the line X—X in FIG. 38.
Figure 40:
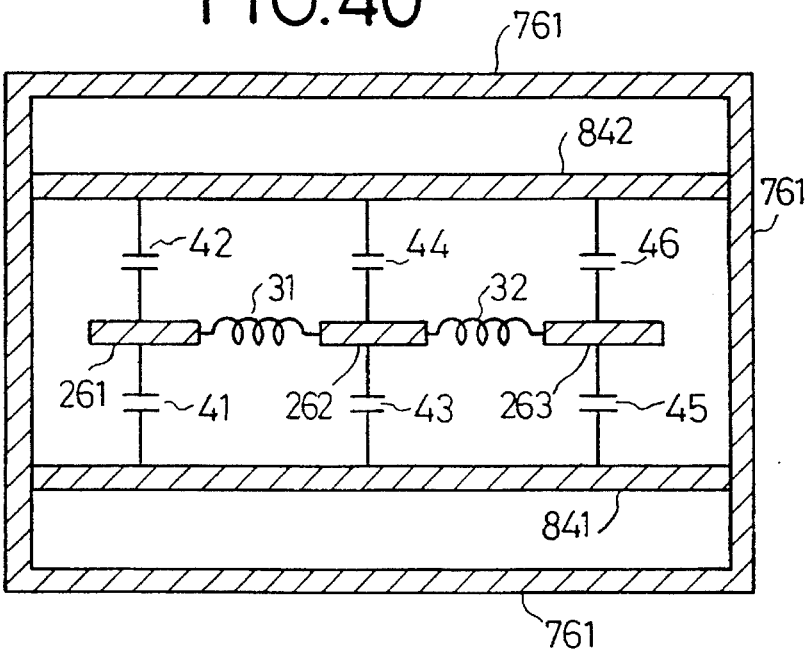
FIG. 40 is a cross-sectional view taken along the line Y—Y in FIG. 38.

FIG. 38 is a plan view showing a spatial structure of the resonators 261, 262, 263, the electrodes 361, 362, 363, the input electrode 461, the output electrode 462, the internal ground electrodes 841, 842 and the coupling adjusting electrodes 902, 903 all employed in the present embodiment and constructed as described above. FIGS. 39 and 40 are a cross-sectional view taken along the line X—X in FIG. 38, and a cross-sectional view taken along the line Y—Y in FIG. 38, respectively.

Capacitances 21, 22, 23 are respectively induced between the respective open-circuited end portions of the resonators 261, 262, 263 and the respective electrodes 361, 362, 363.

A capacitance 11 is induced between the input electrode 461 and the resonator 261, and a capacitance 12 is induced between the output electrode 462 and the resonator 263.

Further, a capacitance 53 is induced between the resonator 261 and the coupling adjusting electrode 902, and a capacitance 54 is induced between the resonator 262 and the coupling adjusting electrode 902. A capacitance 55 is induced between the resonator 262 and the coupling adjusting electrode 903, and a capacitance 56 is induced between the resonator 263 and the coupling adjusting electrode 903.

Furthermore, capacitances 41, 42 are induced between the open-circuited end portion of the resonator 261 and the internal ground electrode 841 and between the open-circuited end portion thereof and the internal ground electrode 842, respectively. Capacitances 43, 44 are induced between the open-circuited end portion of the resonator 262 and the internal ground electrode 841 and between the open-circuited end portion thereof and the internal ground electrode 842, respectively. Capacitances 45, 46 are induced between the open-circuited end portion of the resonator 263 and the internal ground electrode 841 and between the open-circuited end portion thereof and the internal ground electrode 842, respectively. Due to the existence of the capacitances 21 through 23 and 41 through 46, the resonators 261, 262 and 262, 263 are respectively coupled with one another by inductances 31, 32.

Figure 41:
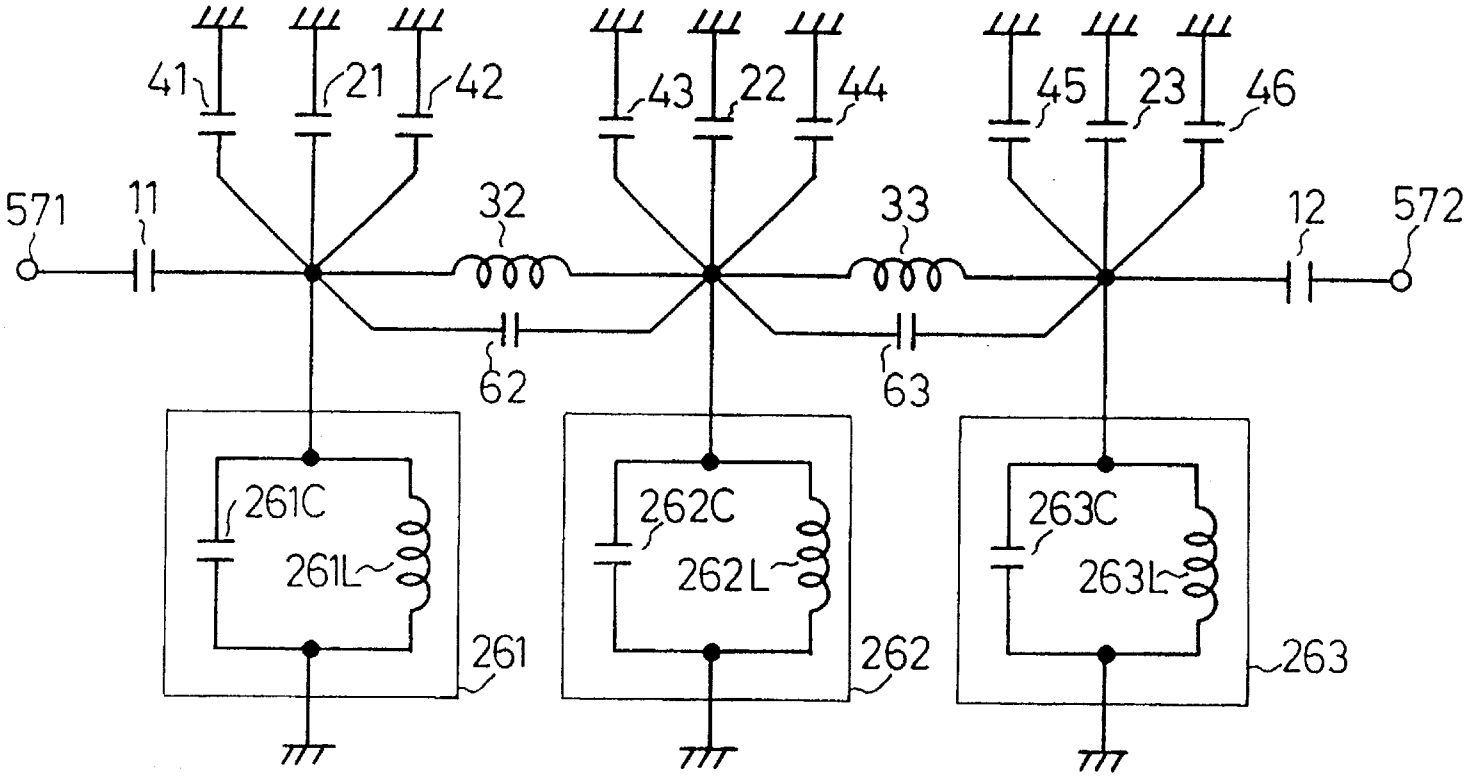
FIG. 41 is an equivalent circuit diagram of the transmission line filter of the tenth embodiment of the present invention.

An equivalent circuit of the transmission line filter constructed as described above is shown in FIG. 41 and exhibits a bandpass characteristic. In FIG. 41, reference numeral 62 indicates the combined capacitance corresponding to the sum of the capacitance 53 induced between the resonator 261 and the coupling adjusting electrode 902 and the capacitance 54 induced between the resonator 262 and the coupling adjusting electrode 902. Further, reference numeral 63 indicates the combined capacitance equal to the sum of the capacitance 55 induced between the resonator 262 and the coupling adjusting electrode 903 and the capacitance 56 induced between the resonator 263 and the coupling adjusting electrode 903. Moreover, capacitances 261C, 262C, 263C and inductances 261L, 262L, 263L of parallel resonance circuits are capacitances and inductances obtained by expressing the resonators 261, 262, 263 with the lumped-constant equivalent circuit.

In the case of the present embodiment, because the capacitance 62 is connected in parallel to the inductance 32 induced between the resonators 261 and 262, and because the capacitance 63 is connected in parallel to the inductance 33 induced between the resonators 262 and 263, the inductive coupling which is induced between the resonators 261 and 262, and is represented by the inductance 32, can be controlled by the capacitance 62, and the inductive coupling, which is induced between the resonators 262 and 263, and is represented by the inductance 33, can be controlled by the capacitance 63. Therefore, the degree of the inductive coupling between the resonators 261 and 262 and between the resonators 262 and 263 can be adjusted by adjusting the values of the capacitances 62, 63, thereby making it possible to obtain a filter having a desired bandwidth.

Furthermore, because the capacitance 62 is the combined capacitance equal to the sum of the capacitance 53 induced between the resonator 261 and the coupling adjusting electrode 902 and the capacitance 54 induced between the resonator 262 and the coupling adjusting electrode 902, and because the capacitance 63 is the combined capacitance equal to the sum of the capacitance 55 induced between the resonator 262 and the coupling adjusting electrode 903 and the capacitance 56 induced between the resonator 263 and the coupling adjusting electrode 903, the values of the capacitances 62, 63 can be easily adjusted by adjusting the areas at which the resonators 261, 262 and the coupling adjusting electrode 902 overlap each other and the distances defined therebetween and the areas at which the resonators 262, 263 and the coupling adjusting electrode 903 overlap each other and the distances defined therebetween.

In the present embodiment, because the coupling adjusting electrode 902 is formed on the dielectric layer 163 placed under the dielectric layer 164 on which the resonators 261 through 263 provided, and the coupling adjusting electrode 903 is formed on the dielectric layer 165 placed on the dielectric layer 164 on which the resonators 261 through 263 provided. Therefore, the area at which the coupling adjusting electrode 902 overlaps the resonator 262 and the area at which the coupling adjusting electrode 903 overlaps the resonator 262, can be independently increased, thereby making it possible to create large capacitances between the coupling adjusting electrode 902 and the resonator 262 and between the coupling adjusting electrode 903 and the resonator 262, respectively. If it is possible to create such large capacitances, then the inductive coupling between the resonators 261 and 262 and the inductive coupling between the resonators 262 and 263 can be adjusted by the large capacitances, thereby making it possible to obtain easily a filter having a desired bandwidth.

In the present embodiment, the internal ground electrodes 841, 842 are disposed in the opposed facing relationship to the open-circuited end portions of the resonators 261, 262, 263. Therefore, the capacitances 41, 42 respectively induced between the open-circuited end portion of the resonator 261 and the respective internal ground electrodes 841, 842 are added to the capacitance 261C of the parallel resonance circuit, which is obtained by expressing the resonator 261 with the lumped-constant equivalent circuit. Further, the capacitances 43, 44 respectively induced between the open-circuited end portion of the resonator 262 and the respective internal ground electrodes 841, 842 are added to the capacitance 262C of the parallel resonance circuit, which is obtained by expressing the resonator 262 with the lumped-constant equivalent circuit. Moreover, the capacitances 45, 46 respectively induced between the open-circuited end portion of the resonator 263 and the respective internal ground electrodes 841, 842 are added to the capacitance 263C of the parallel resonance circuit, which is obtained by expressing the resonator 263 with the lumped-constant equivalent circuit. Thus, if the resonance frequencies of the two parallel resonance circuits are not changed, then the inductances 261L, 262L, 263L of the parallel resonance circuits become small. As a result, the length of each of the resonators 261, 262, 263 becomes shorter. Therefore, the entire length of the transmission line filter can also be reduced.

In this case, a problem arises that when the areas at which the internal ground electrodes 841, 842 respectively overlap the resonators 261, 262, 263, are increased to reduce the transmission line filter in size, the resonators 261, 262 and 262, 263 become more strongly inductively-coupled to one another, thereby making the bandwidth of the filter characteristic too broad. In the present embodiment, however, because the coupling adjusting electrode 902 is disposed in the opposed facing relationship to each of the resonators 261, 262 and the coupling adjusting electrode 903 is disposed in the opposed facing relationship to each of the resonators 262, 263, the inductive coupling between the resonators 261 and 262 and the inductive coupling between the resonators 262 and 263 can be controlled by means of the capacitances 53, 54 respectively induced between the coupling adjusting electrode 902 and the respective resonators 261, 262 and the capacitances 55, 56 respectively induced between the coupling adjusting electrode 903 and the respective resonators 262, 263, thereby making it possible to obtain a filter having a desired bandwidth. Thus, a transmission line filter which does not cause an excessive increase in the bandwidth of the filter characteristic even if the transmission line filter is reduced in size, can be obtained by providing the internal ground electrode 841, 842 respectively disposed in the opposed facing relationship to the open-circuited end portions of the resonators 261 through 263, the coupling adjusting electrode 902 disposed in the opposing relationship to each of the resonators 261, 262 and by providing the coupling adjusting electrode 903 disposed in the opposed facing relationship to the resonators 262, 263.

In the present embodiment, as described above, by providing the coupling adjusting electrode 902 in the opposed facing relationship to the resonators 261, 262, the combined capacitance 62 of the capacitances 53, 54 respectively induced between the respective resonators 261, 262 and the coupling adjusting electrode 902 is connected in parallel to the inductance 32 induced between the resonators 261 and 262. Further, by providing the coupling adjusting electrode 903 in the opposed facing relationship to the resonators 262, 263, the combined capacitance 63 of the capacitances 55, 56 respectively induced between the respective resonators 262, 263 and the coupling adjusting electrode 903 is connected in parallel to the inductance 33 induced between the resonators 262 and 263. Therefore, a parallel resonance circuit composed of the capacitance 62 and the inductance 32 is inserted between the resonators 261 and 262 and a parallel resonance circuit composed of the capacitance 63 and the inductance 33 is inserted between the resonators 262 and 263. Because each of both the impedance of the parallel resonance circuit composed of the capacitance 62 and the inductance 32 and the impedance of the parallel resonance circuit composed of the capacitance 63 and the inductance 33 varies from an inductive to capacitive at points before and after the parallel resonance point in the same manner as described in the ninth embodiment. Therefore, the coupling between the resonators 261 and 262 and between the resonators 262 and 263 can be made either inductive or capacitive by adjusting the values of the capacitances 53, 54 respectively induced between the respective resonators 261, 262 and the coupling adjusting electrode 902 and between the respective resonators 262, 263 and the coupling adjusting electrode 903. Assuming now that the couplings between the resonators 261 and 262 and between the resonators 262 and 263 are made inductive, then a filter having the attenuation peak on the high-frequency side can be obtained. When, on the other hand, the couplings between the resonators 261 and 262 and between the resonators 262 and 263 are made capacitive, then a filter having the attenuation peak on the low-frequency side can be obtained. Thus, the attenuation characteristics of the filters can be improved even in either case.

A method of manufacturing the transmission line filter according to the present embodiment will next be explained. The conductor patterns shown in FIG. 37 are respectively printed on the green sheets employed in the first embodiment by using a silver paste as a conductor paste. In order to adjust the thickness of the green sheets on which the conductor patterns are printed, necessary green sheets are then stacked so as to form the structure shown in FIG. 37. The resultant product is thereafter fired at 900° C. to produce a layered product 1000.

The ground electrode 761 composed of a silver electrode, is printed on the upper and lower surfaces of the layered product 1000 and the side surfaces thereof other than the input terminal portion 671 and the output terminal portion 672 as shown in FIG. 30. Further, silver electrodes insulated from the ground electrode 761 and respectively connected to the input electrode 461 and the output electrode 462, are printed in the input and output terminal portions 671, 672 as the input and output terminals 571, 572, respectively. The printed silver electrodes are fired at 850° C.

Having now fully described the invention, it will be apparent to those skilled in the art that many changes and modifications can be made without departing from the spirit or scope of the invention as set forth herein.

What is claimed is:

1. A transmission line filter, comprising:

a dielectric body;

a first ground electrode provided on an outer surface of said dielectric body;

a first resonator disposed in said dielectric body, having an end portion short-circuited to said first ground electrode, an open-circuited end portion, and first and second opposite main surfaces;

a second resonator disposed in said dielectric body and being inductively coupled to said first resonator, said second resonator having an end portion short-circuited to said first ground electrode, an open-circuited end portion, and first and second opposite main surfaces;

a first coupling adjusting electrode having a main surface and being disposed in said dielectric body such that said main surface of said first coupling adjusting electrode opposes a portion of said first main surface of said first resonator and a portion of said first main surface of said second resonator.

2. A transmission line filter as recited in claim 1, further comprising an internal ground electrode disposed in said dielectric body, said internal ground electrode having a main surface which opposes said first resonator at said open-circuited end portion of said first resonator and said second resonator at said open-circuited end portion of said second resonator.

3. A transmission line filter as recited in claim 1, further comprising:

a third resonator disposed in said dielectric body and being inductively coupled to said first resonator, said third resonator having an end portion short-circuited to said first ground electrode, an open-circuited end portion, and first and second opposite main surfaces, said first resonator being disposed between said second resonator and said third resonator; and a second coupling adjusting electrode having a main surface and being disposed in said dielectric body such that said main surface of said second coupling adjusting electrode opposes a portion of said second main surface of said first resonator and a portion of said second main surface of said third resonator.

4. A transmission line filter as recited in claim 3, further comprising an internal ground electrode disposed in said dielectric body, said internal ground electrode having a main surface which opposes said first resonator at said open-circuited end portion of said first resonator, said second resonator at said open-circuited end portion of said second resonator, and said third resonator at said open-circuited end portion of said third resonator.

5. A transmission line filter as recited in claim 1, further comprising a second ground electrode, said first and second ground electrodes being disposed on respective opposite outer surfaces of said dielectric body.

6. A transmission line filter as recited in claim 5, further comprising an internal ground electrode disposed in said dielectric body, said internal ground electrode having a main surface which opposes said first resonator at said open-circuited end portion of said first resonator, and said second resonator at said open-circuited end portion of said second resonator.

7. A transmission line filter as recited in claim 5, further comprising:

a third resonator disposed in said dielectric body and being inductively coupled to said first resonator, said third resonator having an end portion short-circuited to said first ground electrode, an open-circuited end portion, and first and second opposite main surfaces, said first resonator being disposed between said second resonator and said third resonator; and a second coupling adjusting electrode having a main surface and being disposed in said dielectric body such that said main surface of said second coupling adjusting electrode opposes a portion of said second main surface of said first resonator and a portion of said second main surface of said third resonator.

8. A transmission line filer as recited in claim 7, further comprising an internal ground electrode disposed in said dielectric body, said internal ground electrode having a main surface which opposes said first resonator at said open-circuited end portion of said first resonator, said second resonator at said open-circuited end portion of said second resonator, and said third resonator at said open-circuited end portion of said third resonator.

9. A transmission line filter, comprising:

a dielectric body;

a first ground electrode provided on a first outer surface portion of said dielectric body;

a first resonator disposed in said dielectric body, having an end portion electrically short-circuited to said first ground electrode, an open-circuited end portion, and a first main surface;

a second resonator disposed in said dielectric body, being substantially parallel to said first resonator and inductively coupled to said first resonator, said second resonator having an end portion electrically short-circuited to said first ground electrode, an open-circuited end portion, and a first main surface;

a first coupling adjusting electrode having a main surface and being disposed in said dielectric body such that said main surface of said first coupling adjusting electrode opposes a portion of said first main surface of said first resonator and a portion of said first main surface of said second resonator; and an internal ground electrode electrically short-circuited to said first ground electrode, disposed in said dielectric body, said internal ground electrode having a main surface which opposes said first resonator at said open-circuited end portion thereof and said second resonator at said open-circuited end portion thereof.

10. A transmission line filter as recited in claim 9, further comprising a second ground electrode electrically connected to said first ground electrode, disposed on a second outer surface portion of said dielectric body.

11. A transmission line filter as recited in claim 9, wherein said first resonator has a second main surface in an opposed relationship to said first main surface thereof, said transmission line filter further comprising:

a third resonator disposed in said dielectric body, said third resonator being substantially parallel to said first resonator and said second resonator and being inductively coupled to said first resonator, said third resonator having an end portion electrically short-circuited to said first ground electrode, an open-circuited end portion, and a first main surface, said first resonator being disposed between said second resonator and said third resonator; and a second coupling adjusting electrode having a main surface and being disposed in said dielectric body such that said main surface of said second coupling adjusting electrode opposes a portion of said second main surface of said first resonator and a portion of said first main surface of said third resonator.

12. A transmission line filter as recited in claim 11, wherein said third resonator is coplanar with said first resonator and said second resonator.

13. A transmission line filter as recited in claim 12, further comprising a second ground electrode electrically connected to said first ground electrode, disposed on a second outer surface portion of said dielectric body.

14. A transmission line filter as recited in claim 11, wherein the main surface of said internal ground electrode opposes said third resonator at said open-circuited end portion thereof.

15. A transmission line filter as recited in claim 14, further comprising a second ground electrode electrically connected to said first ground electrode, disposed on a second outer surface portion of said dielectric body.

* * * * *